US007447469B2

(12) United States Patent
Uchiyama et al.

(10) Patent No.: US 7,447,469 B2
(45) Date of Patent: Nov. 4, 2008

(54) IMAGE FORMING DEVICE AND MOUNTING MEMBER FOR MOUNTING A TONER CONTAINER THEREON

(75) Inventors: Misaki Uchiyama, Tokyo (JP); Kazuosa Kuma, Kanagawa (JP); Kiyonori Tsuda, Kanagawa (JP); Hiroshi Ishii, Kanagawa (JP); Yuusuke Noguchi, Kanagawa (JP); Makoto Kikura, Kanagawa (JP); Yutaka Fukuchi, Kanagawa (JP); Kazuki Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 54 days.

(21) Appl. No.: 11/247,269

(22) Filed: Oct. 12, 2005

(65) Prior Publication Data

US 2006/0083555 A1 Apr. 20, 2006

(30) Foreign Application Priority Data

| | | |
|---|---|---|
| Oct. 18, 2004 | (JP) | 2004-303193 |
| Feb. 22, 2005 | (JP) | 2005-045087 |
| Jun. 2, 2005 | (JP) | 2005-162361 |
| Aug. 26, 2005 | (JP) | 2005-246496 |

(51) Int. Cl.
*G03G 15/08* (2006.01)

(52) U.S. Cl. ..... 399/262; 399/258

(58) Field of Classification Search ..... 399/119, 399/223, 258, 262, 299
See application file for complete search history.

(56) References Cited

U.S. PATENT DOCUMENTS

| | | | | |
|---|---|---|---|---|
| 6,898,407 | B2 | 5/2005 | Noguchi et al. | |
| 6,937,838 | B2 | 8/2005 | Ishii et al. | |
| 7,016,629 | B2 | 3/2006 | Ishii et al. | |
| 7,043,173 | B2 * | 5/2006 | Grune et al. | 399/262 X |
| 7,162,189 | B2 | 1/2007 | Tsuda et al. | |
| 7,263,309 | B2 | 8/2007 | Noguchi et al. | |
| 7,333,749 | B2 | 2/2008 | Noguchi et al. | |
| 2004/0096239 | A1 | 5/2004 | Hosokawa et al. | |
| 2004/0126150 | A1 * | 7/2004 | Noguchi et al. | 399/299 |
| 2004/0131381 | A1 | 7/2004 | Kawasumi et al. | |
| 2004/0170446 | A1 | 9/2004 | Nagashima et al. | |
| 2004/0170447 | A1 | 9/2004 | Arai et al. | |
| 2004/0184841 | A1 | 9/2004 | Tsuda et al. | |
| 2004/0208676 | A1 | 10/2004 | Ishii et al. | |

(Continued)

FOREIGN PATENT DOCUMENTS

CN 1501192 A 6/2004

(Continued)

OTHER PUBLICATIONS

U.S. Appl. No. 10/667,301, filed Sep. 23, 2003, Kiyonori Tsuda et al.

(Continued)

*Primary Examiner*—Sandra L. Brase
(74) *Attorney, Agent, or Firm*—Oblon, Spivak, McClelland, Maier & Neustadt, P.C.

(57) ABSTRACT

A toner container mounting member comprises mounted thereon a plurality of toner containers that perform supply of toner by being themselves rotated. The toner containers are laid in the same direction to be mounted/released from above; a plurality of guiding members that rotatably support the toner containers are integrally formed.

49 Claims, 23 Drawing Sheets

U.S. PATENT DOCUMENTS

| | | | |
|---|---|---|---|
| 2004/0223790 | A1 | 11/2004 | Hosokawa et al. |
| 2004/0258432 | A1 | 12/2004 | Hatori et al. |
| 2004/0265011 | A1 | 12/2004 | Tsuda et al. |
| 2005/0008393 | A1 | 1/2005 | Kuma et al. |
| 2005/0036810 | A1 | 2/2005 | Murakami et al. |
| 2005/0084293 | A1 | 4/2005 | Fukuchi et al. |
| 2005/0169653 | A1 | 8/2005 | Noguchi et al. |
| 2005/0281590 | A1 | 12/2005 | Tsuda et al. |
| 2007/0071502 | A1 | 3/2007 | Shimizu |

FOREIGN PATENT DOCUMENTS

| | | | |
|---|---|---|---|
| CN | 1503072 | A | 6/2004 |
| EP | 1 403 733 | A1 | 3/2004 |
| EP | 1 434 108 | A2 | 6/2004 |
| JP | 2002-139905 | | 5/2002 |
| JP | 2002-169365 | | 6/2002 |
| JP | 2004-139031 | | 5/2004 |

OTHER PUBLICATIONS

U.S. Appl. No. 10/792,694, filed Mar. 5, 2004, Kiyonori Tsuda et al.
U.S. Appl. No. 11/066,270, filed Feb. 28, 2005, Kazuosa Kuma et al.
U.S. Appl. No. 11/081,591, filed Mar. 17, 2005, Mitsuru Yamada et al.
U.S. Appl. No. 11/521,559, filed Sep. 15, 2006, Shimizu.
U.S. Appl. No. 11/612,865, filed Dec. 19, 2006, Tsuda et al.
U.S. Appl. No. 11/836,298, filed Aug. 9, 2007, Tusda et al.
U.S. Appl. No. 11/748,533, filed May 15, 2007, Yoshida et al.
U.S. Appl. No. 12/042,848, filed Mar. 5, 2008, inventor Kita et al.
U.S. Appl. No. 12/019,984, filed Jan. 25, 2008, inventor Tsuda et al.
U.S. Appl. No. 12/020,172, filed Jan. 25, 2008, inventor Tsuda et al.

* cited by examiner

IMAGE FORMING DEVICE AND MOUNTING MEMBER FOR MOUNTING A TONER CONTAINER THEREON

BACKGROUND OF THE INVENTION

1. Field of the Invention

The present invention relates to an image forming device such as an electrophotographic type copier, printer, a facsimile machine or machine combining these functions and in particular relates to a mounting member for mounting toner containers such as toner bottles that accommodate toner constituting developer on an image forming device.

2. Description of the Related Art

As disclosed for example in Laid-open Japanese Patent Application No. 2002-139905, in one recent type of image forming device, toner supply action from a toner container such as a toner bottle wherein the toner that supplies a developing device is accommodated is performed by discharging toner from within the bottle to the outside from a toner supply port by rotating the bottle itself. Such a toner container is formed in a cylindrical shape extending in the direction of the axis of rotation thereof, and is formed in its outer surface with helical projections projecting towards the interior of the bottle; toner in the container is fed to the toner supply port by rotation of the bottle.

However, since the mounting member for mounting the toner container on such an image forming device is constituted so as to mount/release the toner container with respect to the mounting member from the direction of the axis of rotation thereof, when the toner container is to be mounted or released, a working space of about the entire length of the toner container in the direction of the rotary axis is required. Consequently, in an image forming device comprising a mounting member in this system, in arranging the mounting/releasing side of the toner container adjacent to a wall or pillar or the like, the direction of installation and/or the location of installation thereof is restricted by the fact that this mounting member may interfere with mounting/release of the toner container. Since the toner container is mounted/released from the direction of the axis of rotation, it is difficult to see the mounting section because of the toner container and if for example the hand of the operator shakes when effecting mounting/release operation, positional location in the mounting position is difficult. This therefore adversely affects ease of mounting and for example some mechanism for holding/fixing the toner container in the mounted position becomes necessary, leading to the problem of increased costs.

Furthermore, in recent years, in order to perform management of the toner container, it has become the practice to store information peculiar to the toner container, such as the frequency of use of the toner container or management data of the limit of use of the toner container in a memory chip mounted on the toner container. In order to perform reading/writing of information to this memory chip when the toner container is mounted in the main unit of the image forming device, it is necessary to electrically connect the memory chip with the main unit simultaneously with mounting of the toner container. However, if the connector terminal that is used to effect electrical connection between the toner container and the main unit is deformed by some external force from outside, a poor connection may result.

For example, in Laid-open Japanese Patent Application No. 2002-169365, it is stated that the device is so constructed that, simultaneously with setting of the toner container in position on the main unit of the image forming device, electrical connection is effected between these. However, no means for preventing deformation or damage or destruction (for example deformation of the connector terminal) of this electrical connection caused by unwanted external force is disclosed.

Also, in Laid-open Japanese Patent Application No. 2004-139031, it is stated that, when the toner bottle is set in position in the printer main unit, the relay connector that is provided on the toner bottle determines the amount of toner that is present in the toner bottle main unit by reading information as to the amount of toner that is input to an ID chip mounted on the printer main unit, and thereby determines the timing of the operation of introduction of toner to the developer device, in accordance with the information regarding the amount of toner that is acquired by this reading process. However, no means for preventing deformation or damage or destruction of the electrical connection of this intermediate connector and the ID chip is disclosed.

SUMMARY OF THE INVENTION

A first object of the present invention is to provide an image forming device and mounting member for mounting a toner container thereon whereby mounting and releasing thereof is very easily performed while ensuring visibility of the entire toner container, yet wherein costs can be kept low.

A second object of the present invention is to provide an image forming device wherein secure mounting of the toner container in the main unit of the image forming device can be verified electrically.

A third object of the present invention is to provide an image forming device wherein the connector terminal can be protected so that the connector terminal of the data processing unit provided in the main unit of the image forming device is not deformed, damaged or destroyed, when the toner container is mounted in the main unit of the image forming device.

In accordance with the present invention, there is provided a toner container mounting member whereon a plurality of toner containers that perform supply of toner by being themselves rotated are mounted, wherein the toner containers are laid in the same direction and a plurality of guiding members that rotatably support the toner containers in a manner such that they are capable of mounting/release from above are integrally formed.

Further in accordance with the present invention, there is provided a toner supply unit that supplies toner to a developing device of a corresponding color from toner containers accommodating toners of a plurality of colors, comprising: a toner container mounting member that is capable of rotating and mounting and releasing the toner containers; a drive device that rotates the toner containers mounted on the toner container mounting member; and a toner movement channel that guides toner discharged from the toner containers to the developing devices; wherein the toner containers are laid in same direction and a plurality of guide members that are capable of being mounted/released from above and rotatably support the toner containers are integrally formed.

Yet further in accordance with the present invention there is provided an image forming device comprising: a plurality of image carriers on which are formed latent images corresponding to respective colors; a plurality of developing devices that develop the latent images formed on the image carriers; and toner supply devices that supply toner of corresponding colors from the toner containers wherein toner of a plurality of colors is accommodated to the developing devices; the toner supply devices comprising a toner container mounting member that supports the toner containers so as to be capable of rotation and mounting/release; a drive device that rotates the toner containers mounted on the toner container mounting member; and toner movement channels that guide the toner discharged from the toner containers to the developing devices; wherein in the toner container mounting member, the toner containers are laid in the same direction and are capable of being mounted/released from above; and a plurality of guiding members are integrally formed that support the toner containers in rotatable fashion.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
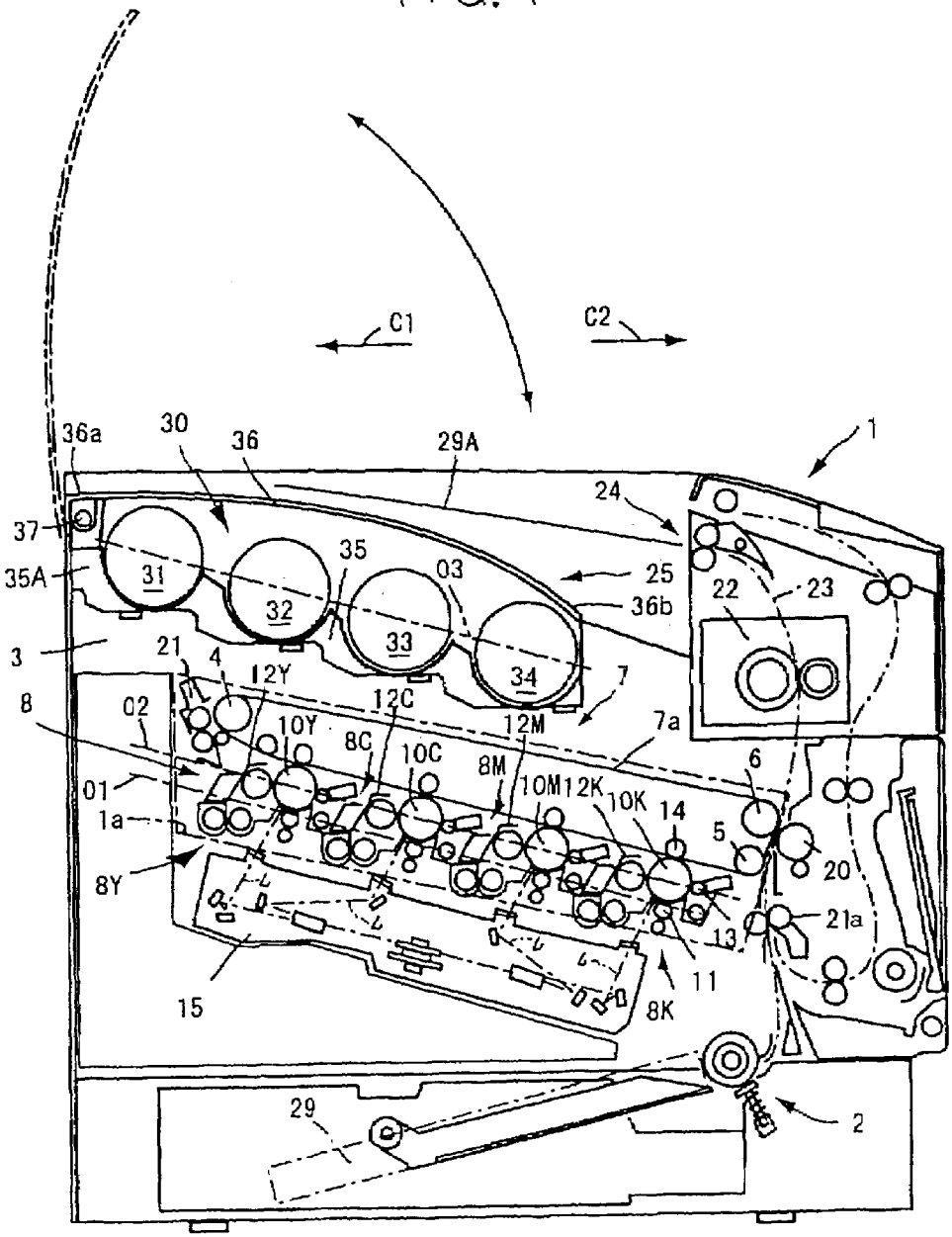
FIG. 1 is an overall constructional diagram of an image forming device according to an embodiment of the present invention.

Embodiments of the present invention are described in detail below with reference to the drawings.

An image forming device according to this embodiment is a color printer (hereinbelow termed a "printer") capable of forming a full-color image, in which the tandem arrangement is adopted. The image forming device is not restricted to the printer shown in FIG. 1 but could be for example a copier, facsimile machine or machine combining these functions.

First of all, the basic construction of a printer and its operation will be described with reference to FIG. 1 and then the construction and operation peculiar to this embodiment will be described.

In this printer, a paper feed unit 2 in which the paper 29 constituting the recording medium is accommodated is arranged below the device main unit 1 and an image forming unit 3 is arranged thereabove. The image forming unit 3 comprises an image creation section 8 comprising four image creation units 8Y, 8C, 8M, 8K constituting a plurality of image creation means comprising image carriers, a plurality of rollers 4, 5, 6, an intermediate transfer unit 7 having an intermediate transfer belt 7*a* constituting an intermediate transfer body constituted by a flexible endless belt mounted on these rollers, an optical writing unit 15 whereby optical writing onto the image carriers is performed, and fixing means 22 that fixes a toner image on the paper 29. A feed path 23 for feeding the paper 29 is formed from the paper feed unit 2 to the fixing means 22. Roller 6 is arranged facing the paper feed path 23.

The interval between the roller 4 and the roller 5 of the intermediate transfer belt 7*a* corresponds to the lower reach of this belt. On the intermediate transfer belt 7*a*, a secondary transfer roller 20 constituting a secondary transfer device is arranged facing the feed path 23 in a location facing the roller 6; a belt cleaning device 21 that cleans the surface of the belt is arranged facing the roller 4.

The image creation section 8 is disposed below the intermediate transfer belt 7*a*, by being arranged facing this lower reach. The individual image creation units are respectively provided with image carriers constituted by photosensitive body drums 10Y, 10C, 10M and 10K, that are in contact with the intermediate transfer belt 7*a*. A charging device 11, developing devices 12Y, 12C, 12M and 12K and the cleaning device 13 are respectively arranged around the photosensitive body drums. Transfer rollers 14 constituting the transfer means that perform primary transfer in the respective image creation units are respectively arranged on the inside of the intermediate transfer belt 7*a* in the positions where the photosensitive body drums contact the intermediate transfer belt 7*a*.

The image creation units 8Y, 8C, 8M, 8K are basically of the same construction; reference symbols are attached to the typical image creation unit construction 8K shown in FIG. 1. The difference between the respective image creation units lies in the different color of the toner i.e. developer, that is accommodated in these different developing devices. Yellow, cyan, magenta and black toner are respectively accommodated in the imaging devices 12Y, 12C, 12M, 12K of the image creation units 8Y, 8C, 8M and 8K. When the amount of toner in the developing devices diminishes, replenishment toner is respectively supplied from the toner bottles 31, 32, 33, 34 arranged above the device main unit 1.

In this embodiment, the developing devices 12Y, 12C, 12M, 12K and the photosensitive body drums 10Y, 10C, 10M, 10K are mutually parallel with the line 01 joining the centers of arrangement of the developing devices in the direction of their juxtaposition and the line 02 joining the centers of rotation of the photosensitive body drums. Also, in FIG. 1, they are arranged so as to be inclined downwardly towards the front side of the device (also referred to as the front face of the device) shown by the arrow C2 from the rear face side of the device i.e. the direction of paper discharge, indicated by the arrow C1.

Figure 17:
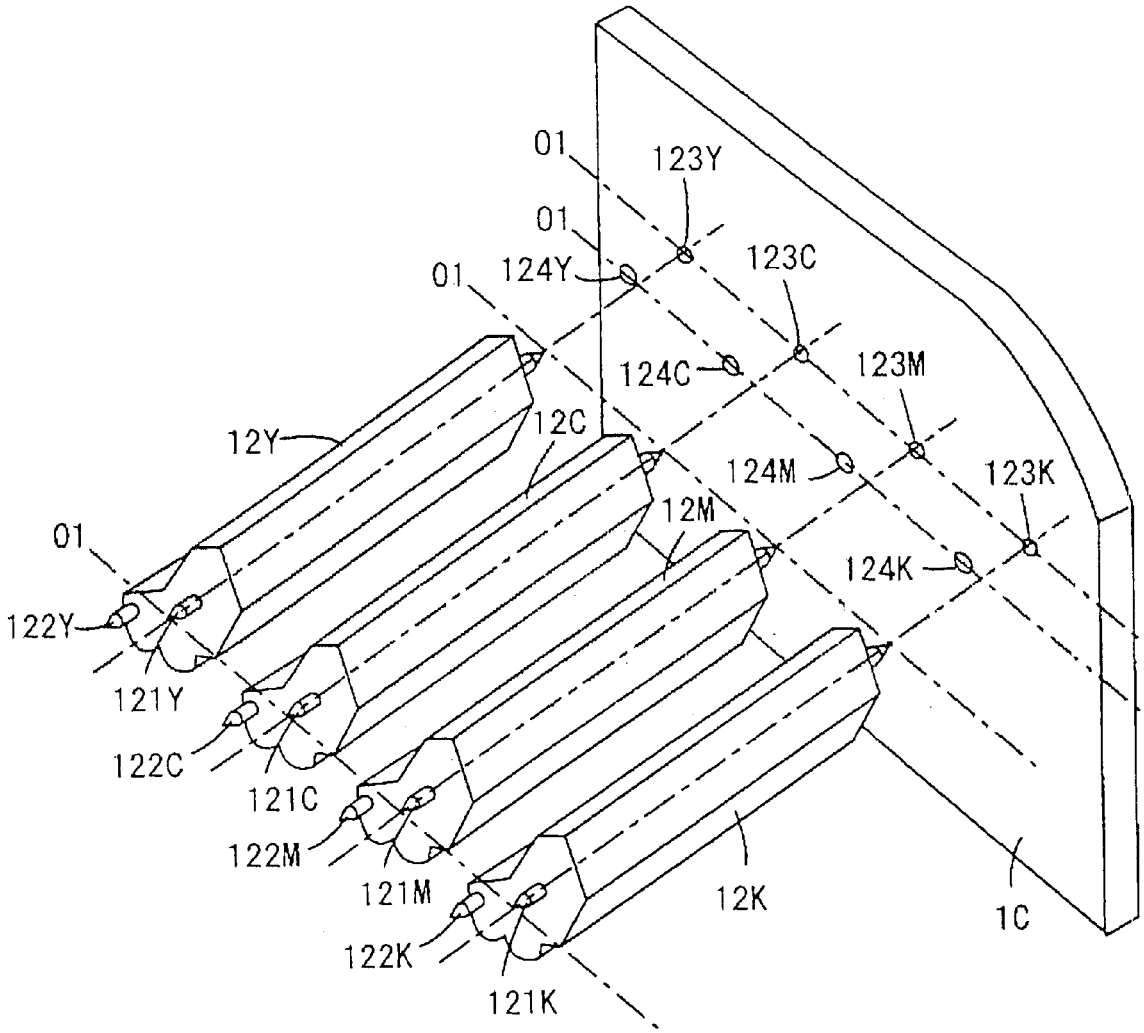
FIG. 17 is a view given in explanation of the centers in the direction of juxtaposition of a plurality of developing devices.

As shown in FIG. 17, the main reference position locating shafts 121Y, 121C, 121M, 121K and the subsidiary reference position locating shafts 122Y, 122C, 122M, 122K are respectively arranged so as to project in the longitudinal direction of the developing devices on both side faces positioned in the axial direction of the developing devices 12Y, 12C, 12M, 12K. The main reference position locating shafts 121Y, 121C, 121M, 121K constitute the main references during mounting onto the device main unit 1; the subsidiary reference position locating shafts 122Y, 122C, 122M, 122K have the function of arresting rotation of the developing devices 12Y, 12C, 12M, 12K after mounting in the device main unit 1. Specifically, on the side frames 1B, 1C that are provided on the device main unit 1, there are respectively formed reference holes 123Y, 123C, 123M, 123K, into which are inserted the main reference position locating shafts 121Y, 121C, 121M, 121K, and slots 124Y, 124C, 124M, 124K into which are respectively inserted the subsidiary reference position locating shafts 122Y, 122C, 122M, 122K.

Figure 4:
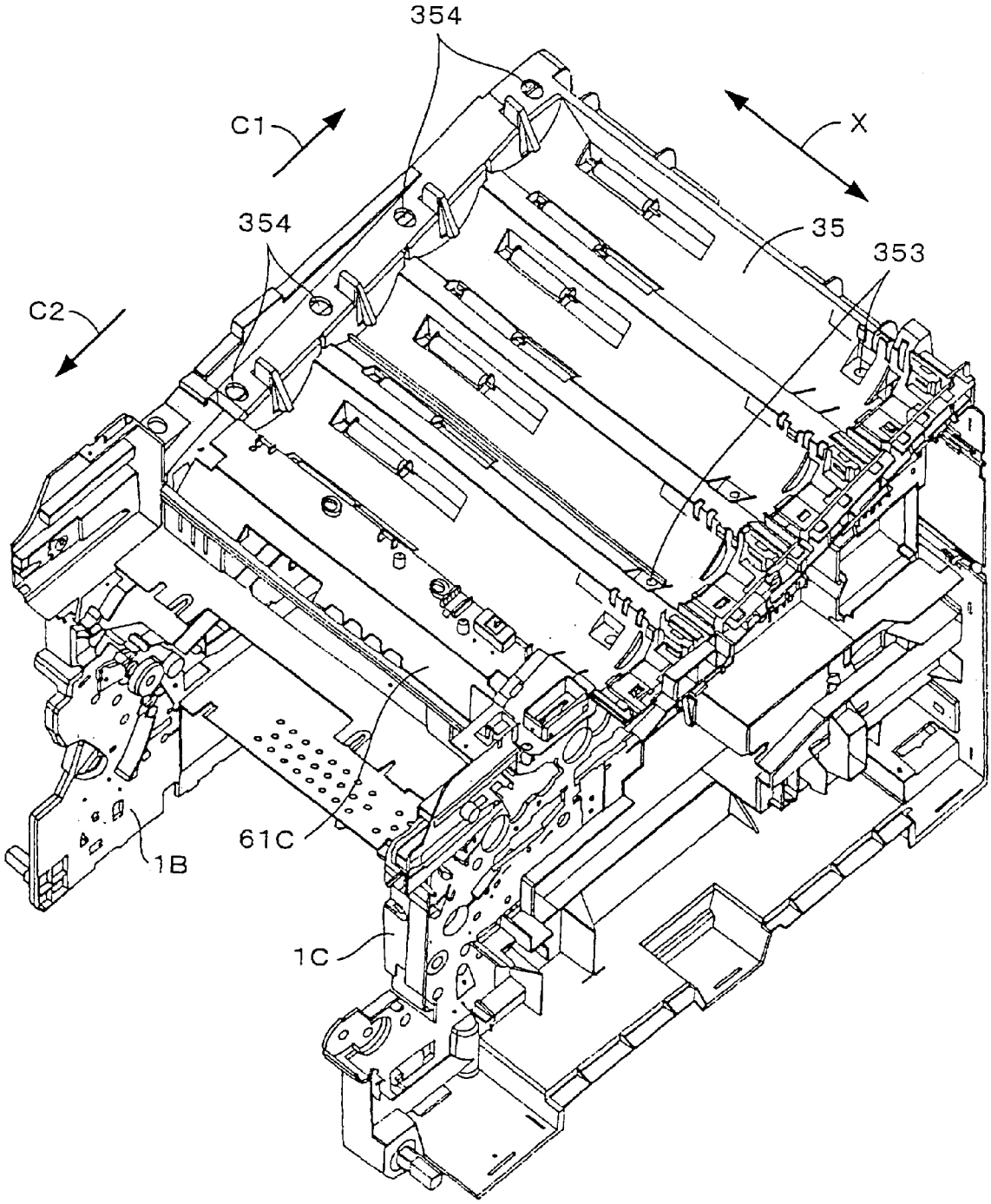
FIG. 4 is a perspective view showing the mounted condition of the toner container mounting member.

In FIG. 17, only the side frame 1C is shown, but, on the side of the side frame 1B shown in FIG. 4, there are formed the reference holes 123Y, 123C, 123M, 122K and the slots 124Y, 124C, 124M and 124K shown in FIG. 17. The reference holes 123Y, 123C, 123M, 123K and the slots 124Y, 124C, 124M, 124K, on the side of the side frame 1B and reference holes 123Y, 123C, 123M, 123K and the slots 124Y, 124C, 124M, 124K, on the side of the side frame 1C are arranged in respectively facing positions, when the developing devices are viewed from the longitudinal direction. In this embodiment, the reference holes 123Y, 123C, 123M, 123K and the slots 124Y, 124C, 124M, 124K that are formed on the side of the side frame 1B are formed on a position-locating faceplate, not shown, that is mounted on the side frame 1B so as to be capable of being freely opened or closed, rather than being formed on the side frame 1B itself. In this embodiment, the developing devices can be mounted on or released from the device main unit 1 by opening or closing this position-locating faceplate, not shown.

With this construction, the line 01 joining the centers of arrangement of the plurality of developing devices in their direction of juxtaposition means a line joining the centers of the main reference position locating shafts 121Y, 121C, 121M, 121K, the centers of the subsidiary reference position locating shafts 122Y, 122C, 122M, 122K, or the centers of the reference holes 123Y, 123C, 123M, 123K and/or slots 124Y, 124C, 124M, 124K in which these are inserted. The centers of the slots 124Y, 124C, 124M, 124K means the point of intersection of the major axes and minor axes of the slots.

An aperture 1*a* is formed in the side face of the device main unit 1. The image creation units 8Y, 8C, 8M, 8K and the intermediate transfer unit 7 are freely releasably mounted with respect to the device main unit 1 from the side of this aperture 1*a*.

The optical writing unit 15 forms a latent image of each color on the surface of the photosensitive body by directing an optically modulated laser beam L onto the surface of the photosensitive body drums. In this embodiment, a construction is adopted wherein the optical writing unit 15 is arranged below the image creation section 8 so that laser irradiation is performed towards the top of the device from the bottom of the device.

When the image forming operation is commenced, the photosensitive body drums 10Y, 10C, 10M, 10K of the respective image creation units are driven in rotation in the clockwise direction by drive means, not shown, with the result that the surfaces of the photosensitive body drums are charged up uniformly with a prescribed polarity by the respective charging devices 11. When laser beams L are respectively directed onto the surfaces of the photosensitive body drums that have thus been charged up from the optical writer unit 15, electrostatic latent images are formed on these surfaces. In this process, the image information that is used in exposure of the photosensitive body drums is single-color image information obtained by analyzing the desired full-color image into color image information in respect of yellow, cyan, magenta and black. When the electrostatic latent image that is thus formed passes between the photosensitive body drums and the developing devices 12Y, 12C, 12M, 12K, it is converted to a toner image i.e. a visible image, by the toner of the respective developing devices.

One of the plurality of rollers 4, 5, 6 on which the intermediate transfer belt 7*a* is mounted is driven in rotation in the anti-clockwise direction by drive means, not shown, so that the intermediate transfer belt 7*a* is driven to run in the anti-clockwise direction as shown by the arrow; the other rollers rotate as followers. The yellow toner image formed by the image creation unit 8Y provided with the developing device 12Y having yellow toner positioned most upstream in the direction of movement of the belt is transferred onto the intermediate transfer belt 7*a* running in this way by the transfer roller 14. Onto the yellow toner image that has thus been transferred, the cyan toner image, and, in addition, the magenta toner image and black toner image formed by the image creation units 8C, 8M and 8K are successively transferred in superimposed fashion by means of the transfer roller 14: a full-color toner image is thus carried on the surface of the intermediate transfer belt 7*a*.

The residual toner adhering to the photosensitive body drum surfaces after transfer of the toner images is removed from the photosensitive body drum surfaces by means of cleaning devices 13 and these surfaces are then subjected to a charge removal action by means of a charge removal device, not shown, and the surface potential is initialized to make ready for the next image formation.

Paper 29 supplied from the paper supply unit 2 is fed onto the feed path 23; the paper feed timing is controlled by a register roller pair 21*a* arranged on the upstream side of the secondary transfer roller 20 and the paper is thereby fed to the region where the roller 6 and the secondary transfer roller 20 face each other. Transfer voltage of the opposite polarity to the toner charging polarity of the toner image on the surface of the intermediate transfer belt is then applied to the secondary transfer roller 20 and the combined toner image on the surface of the intermediate transfer belt 7*a* is thereby transferred onto the paper 29. The paper 29 onto which the toner image has thus been transferred is fed to the fixing means 22 and is subjected to heat and pressure when passing through the fixing means 22 so that the toner image is thereby melted and fixed. The printed article 29A obtained by this fixing of the toner image is fed towards the discharge unit 24 positioned at the end of the feed path 23 and is thereby discharged from this discharge unit 24 into a stacking unit 25 provided above the device main unit 1. After the toner image thereon has thus been transferred to the paper 29, the toner remaining on the intermediate transfer belt 7*a* is removed by means of a cleaning device 21.

With a printer constructed in this way, thanks to the adoption of a transfer process whereby four image creation units 8Y, 8M, 8C, 8K are arranged facing the intermediate transfer belt 7*a* and toner images of the respective colors are successively transferred to the intermediate transfer belt 7*a*, the time required for image creation can be greatly reduced compared with a printer of the type wherein there are provided a single image creation means and a four-color developing device, toner images being transferred in superimposed fashion onto the intermediate transfer belt, before transfer is effected onto the paper. Also, since the stacking unit 25 is arranged above the device main unit 1, the installation area or occupied area is reduced, since the stacking unit 25 does not project from the device main unit 1 at its periphery.

The above description is that of the image forming action when a full-color image is formed on the paper 29; however, it would also be possible to form a single-color image using any one of the image creation units of the image creation section 8, or to form a two-color or three-color image. Also, in the case where monochromatic printing is to be performed using a printer according to this embodiment, an electrostatic latent image may be formed solely on the photosensitive body drum 10K of the image creation unit 8K, developing of the image performed using this unit and transfer of the image effected onto the paper 29, where the image may be fixed by the fixing means 22.

Figure 2:
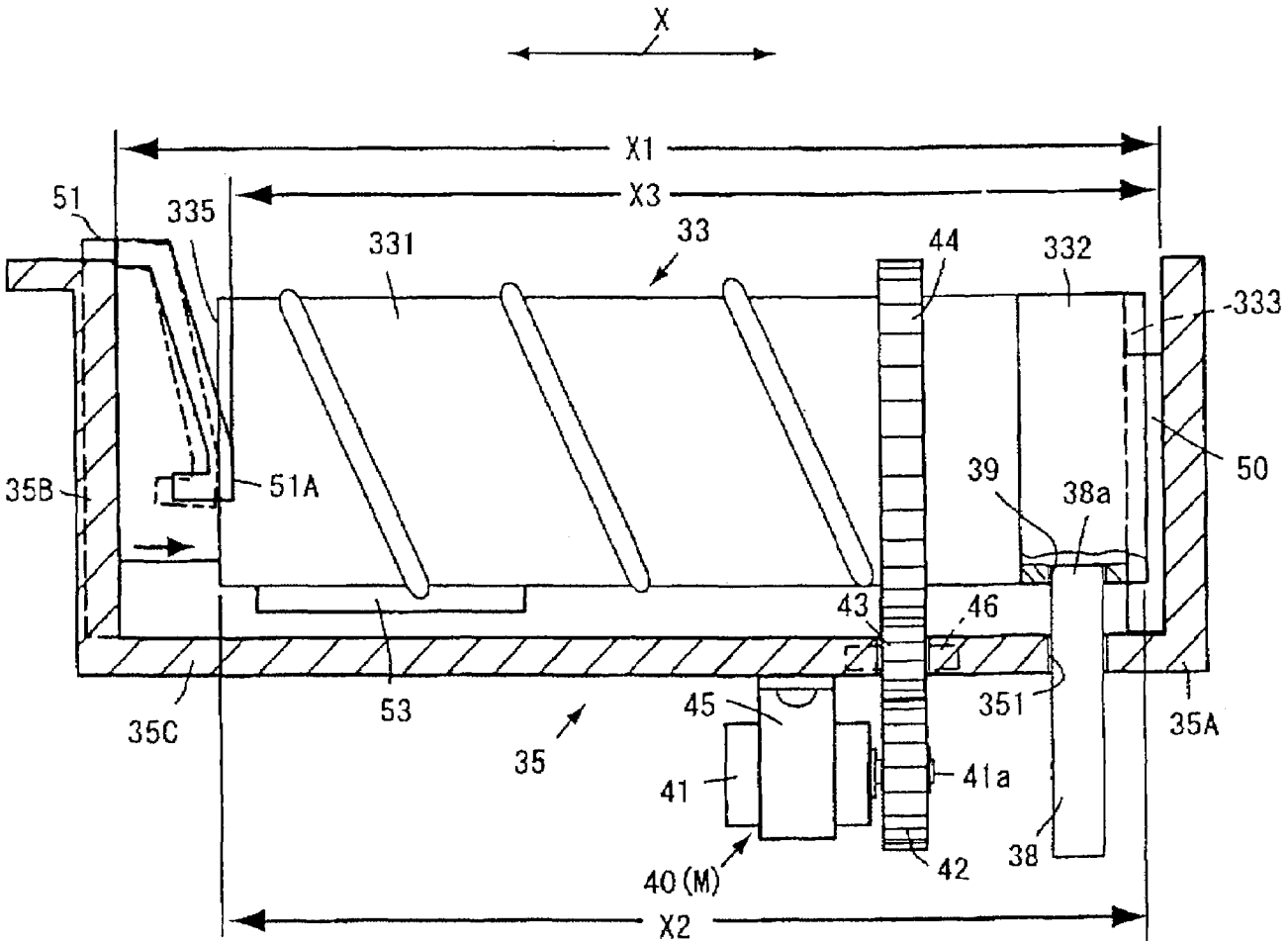
FIG. 2 is a cross-sectional view to a larger scale showing the construction of a toner supply device and toner container mounting member of this image forming device.
Figure 3:
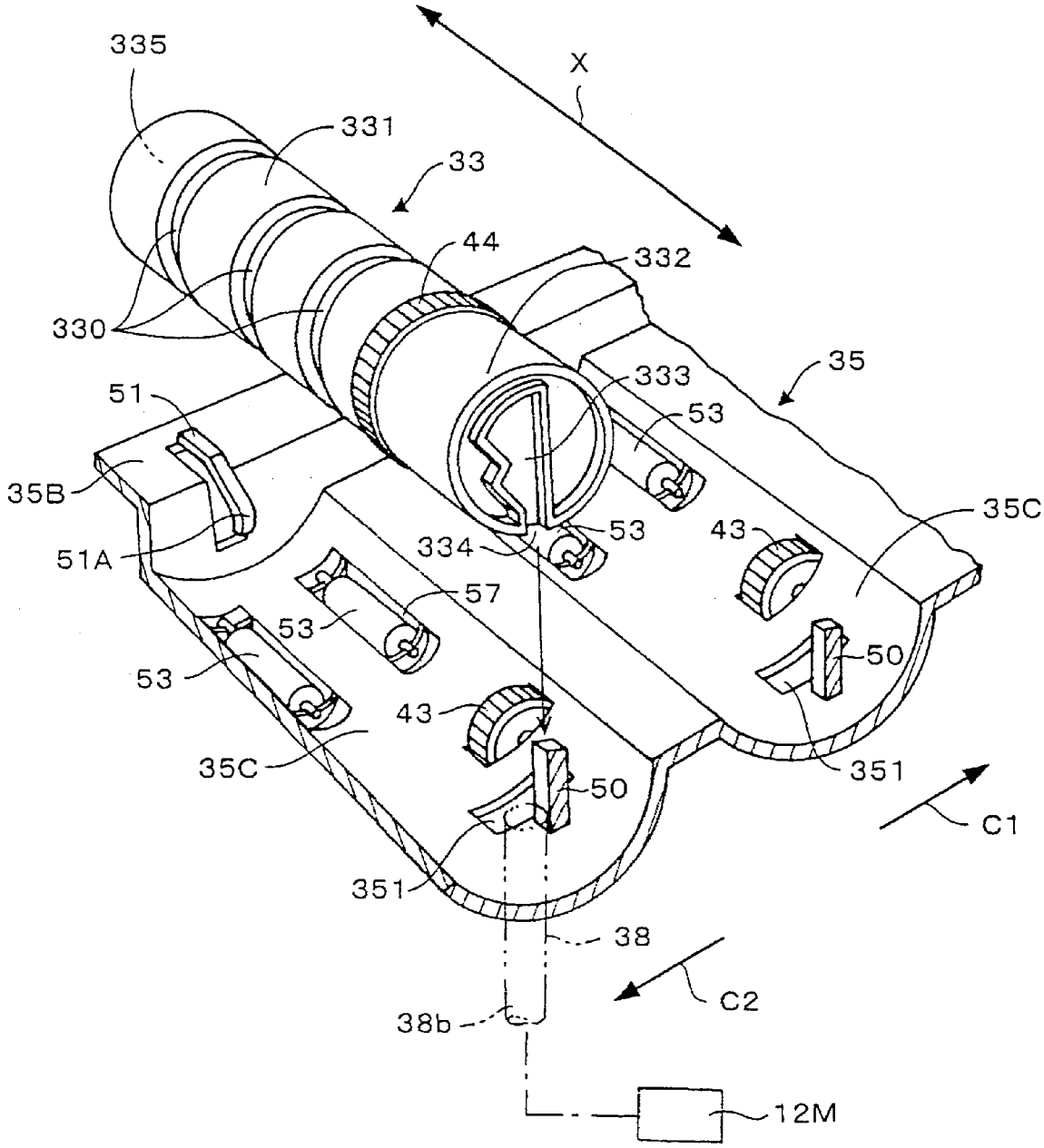
FIG. 3 is a perspective view showing the construction of the toner container mounting member and toner container.

The characteristic construction of this embodiment will now be described. At the top of the device main unit 1, there is arranged a toner supply device 30 that supplies toner to the developing devices of the corresponding color from toner containers constituted by toner bottles 31 to 34. The toner supply device 30 comprises a toner bottle mounting member 35 that rotatably and releasably supports the toner bottles 31, 32, 33, 34, drive means 40 shown in FIG. 2 that respectively rotate the toner bottles mounted on the toner bottle mounting member 35, and toner movement channels 38 whereby the toner that is discharged from the toner bottles is guided to the developing devices. One drive means 40 is provided for each of the toner bottles; these means are basically the same in construction, so the description will be given using the drive means 40(M) that drives the toner bottle 33 in FIG. 2 as a typical example. One end 38*a* of each of the toner movement channels 38 passes through an aperture 351 formed in the toner bottle mounting member 35 and is thus linked with a toner supply port 39 of the toner bottles, while another end 38*b* thereof is linked with the corresponding developing device, as shown in FIG. 3. FIG. 2 and FIG. 3 show an example in which the toner movement channel 38 connects the toner bottle 33 and the developing device 12M.

The drive means 40 comprises a drive motor 41, a drive gearwheel 42 mounted on the output shaft 41*a* of the drive motor 41, and an idle gearwheel 43 that meshes with a gearwheel 44 formed at the peripheral surface of the toner bottle 33 and the drive gearwheel 42. The drive motor 40 is mounted on the toner bottle mounting member 35 with the aid of a bracket 45. The idle gearwheel 43 is freely rotatably supported by a shaft 46 on the toner bottle mounting member 35.

The toner bottle 33 comprises a rotary tubular section 331 formed in tubular shape extending in the direction of the axis of rotation indicated by the reference symbol X in FIG. 3 and formed with a helical projection 330 that projects towards the interior of the bottle at its surface, and a fixed tubular section 332 that freely rotatably supports the rotary tubular section 331 by engaging with one end of the rotary tubular section 331. The gearwheel 44 is formed at the peripheral surface of the rotary tubular section 330 and the toner supply port 39 is formed on the fixed tubular section 332. The construction of the toner bottles 31, 32, 34 is in accordance with the construction of the toner bottle 33.

The toner drive means 40 are arranged on the toner bottle mounting member 35 facing the toner bottles 31, 32, 34; thus, when toner supply is performed by driving the drive motors 40, the toner bottles are driven in rotation and the toner in the rotary tubular section 331 is thereby fed to the fixed tubular section 332 and is thus supplied to the developing devices through the toner supply port 39.

As shown in FIG. 4, the toner bottle mounting member 35 is integrated by being secured by means of screws, not shown, in a securing section indicated by the reference numeral 352, with the tops of the side frames 1B, 1C provided within the device main unit 1. In this embodiment, the side frames 1B, 1C and the toner bottle mounting member 35 are formed by heat-resistant resin. The toner bottles 31 to 34 shown in FIG. 1 are laid in the same direction on the toner bottle mounting member 35 and a plurality of guide members 50, 51 that rotatably support the toner bottles and that are capable of being mounted or released from above are integrally formed therewith. In this embodiment, the toner bottles are mounted by being laid on the toner bottle mounting member 35 in the width direction of the device main unit 1 as seen from the front of the device main unit 1 as shown by the arrow C2. The front face of the device main unit referred to in this case is the front face side of the apparatus: specifically, it is the side of the device main unit 1 positioned on the opposite side to the paper discharge direction C1, and can be expressed as the upstream side of the paper discharge direction C1. That is, the toner bottles can be said to be mounted lying in the width direction X1 of the device main unit 1 as seen from the upstream side of the paper discharge direction C1.

The width direction of the device main unit and the direction X of the axis of rotation are thus made to be the same direction. As shown in FIG. 1, the toner bottle mounting member 35 is formed inclined towards the front side of the device (front face of the device) C1 from the inside C1 of the device, so that the toner bottles are mounted such that the line 03 joining the center of rotation of the toner bottle 34 from the center of rotation of the toner bottle 31 is substantially parallel with the line 01 and the line 02.

Figure 5:
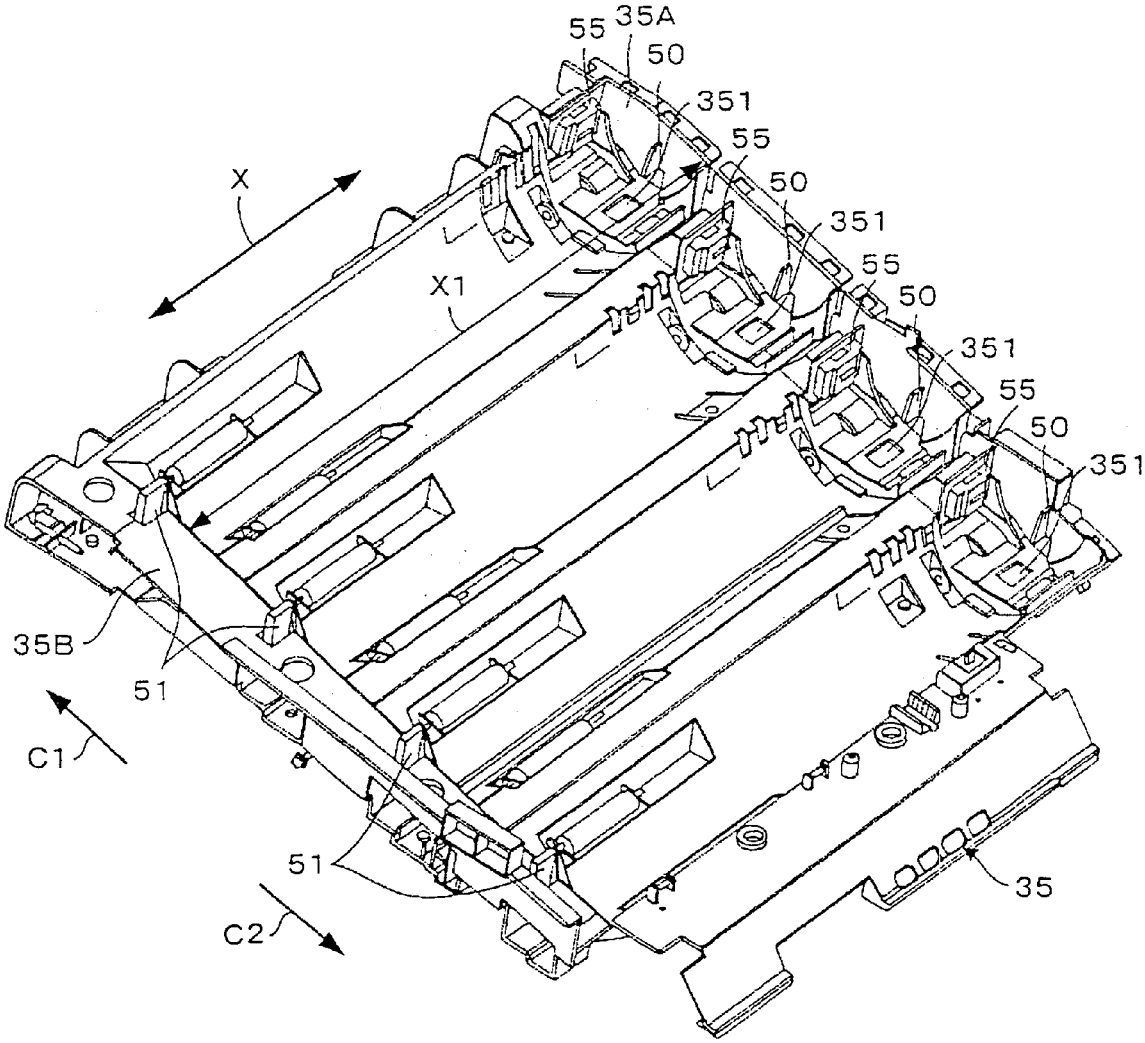
FIG. 5 is a perspective view seen from the top left of the toner container mounting member.

As shown in FIG. 5, the plurality of guiding members 50 are plate-shaped guiding ribs formed on one wall portion 35A at the right as seen from the front face side, which is on one side of the width direction of the device. As shown in FIG. 3, these guiding ribs 50 are arranged in positions capable of insertion in guide grooves 333 formed at the end of the fixed tubular sections 332 of the toner bottles, being formed such that, when the apertures 334 of the guide grooves 333 are below, the ribs are directed such that they can enter the guide grooves 333 from these apertures 334.

Figure 6:
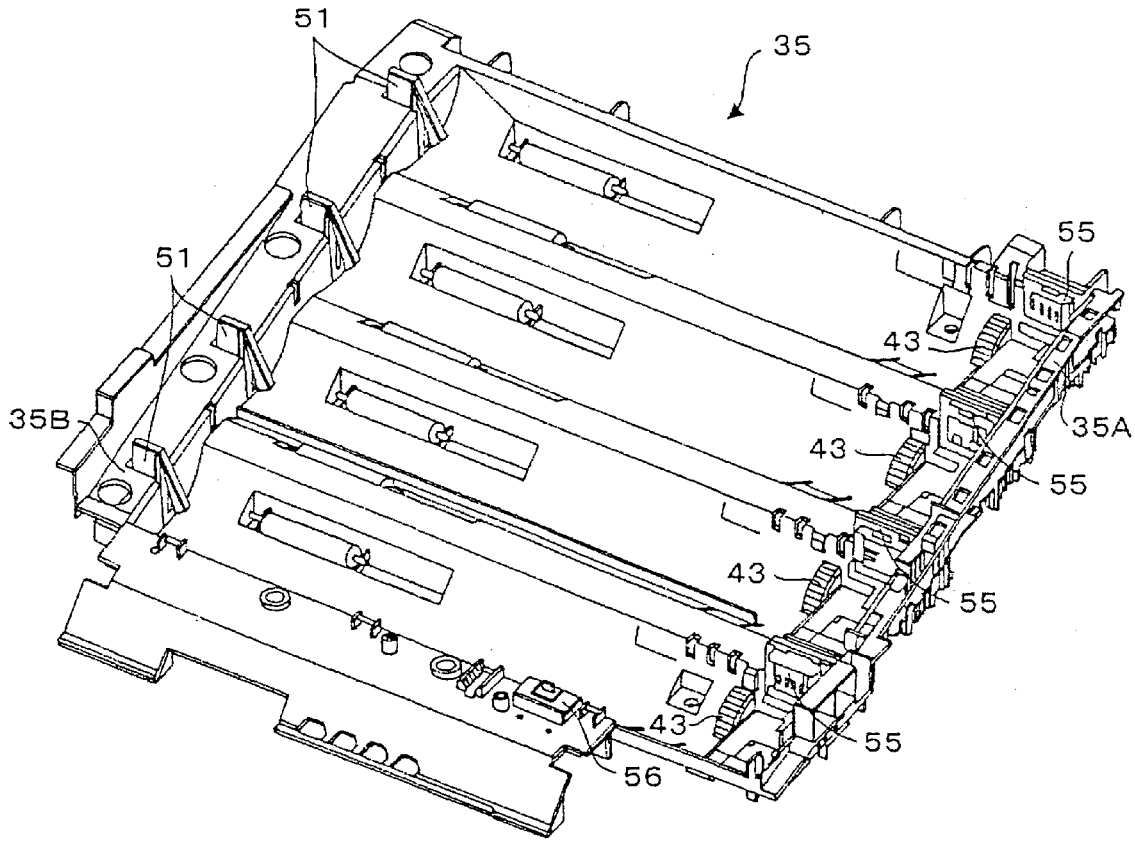
FIG. 6 is a perspective view seen from the top right of the toner container mounting member.

As shown in FIG. 5 and FIG. 6, the plurality of guide members 51 constitute pressing levers made of resin constituting resilient members formed on the other wall section 35B i.e. on the other side in the width direction (X direction) of the device. The internal separation of the wall section 35A and the wall section 35B indicated by the arrow X1 in FIG. 2 is formed somewhat longer than the total length X2 of the toner bottles. Also, the dimension X3 from the wall section 35A to the tips 51A of the pressing levers 51 when the toner bottles are not mounted is such that this is arranged further towards the wall section 35A than the bottle end face 335 when the toner bottles are mounted on the toner bottle mounting member 35. When the fixed tubular section 332 of the toner bottles is mounted supported by the guiding ribs 50, these pressing levers 51 function so as to press the end face 335 of the rotary tubular section 331 of the toner bottles towards the wall section 35A at the tips 51A of the pressing levers 51, by flexing with resilient deformation as shown by the double-dotted chain line in FIG. 2. The gearwheels 43 described above are arranged further towards the wall section 35A.

The opposing face 35C of the toner bottle mounting member 35 facing the toner bottles is formed in curved fashion so as to conform to the peripheral faces of the bottles. A plurality of rollers 53 that support the side of the rotary tubular section 331 of the mounted toner bottles from below are freely rotatably provided on this curved opposing face 35C.

In the vicinity of the wall section 35A, as shown in FIG. 5 and FIG. 6, there are respectively provided toner bottle detection means constituted by detection sensors 55 that detect the mounted condition of the toner bottles.

With this construction, in order to mount the toner bottles on the toner bottle mounting member 35, the apertures 334 of the guide grooves 333 are positioned downwards, and the toner bottles are lowered from above the toner bottle mounting member 35 (device main unit 1) in a condition with the guide grooves 333 conforming to the guide ribs 50. When this is done, the pressing levers 51 are flexed by resilient deformation by applying pressure to the end faces 335 of the toner bottles,(see FIGS. 2 and 3) and the end faces 335 are pressed towards the wall section 35A by the lever tips 51A by the opposing force thereof. In this way, the toner bottles are resiliently mounted on the toner bottle mounting member 35. Since rotation of the fixed tubular section 332 is prevented by engagement of the guide grooves 333 and the guide ribs 50, only the rotary tubular section 331 is free for rotation with respect to the fixed tubular section 332. Also, since the drive means 40 is arranged nearer to the wall section 35A, by biasing of the toner bottles towards the wall section 35A, excellent meshing can be achieved between the gearwheel 44 and the idle gearwheel 43, making it possible to reduce drive loss.

Since the toner bottles 31 to 34 that are mounted on the toner bottle mounting member 35 are mounted by being laid in the same direction, making it possible to mount or release these from above the toner bottle mounting member 35 (image forming device), the operation of mounting or releasing the toner bottles 31 can be performed while maintaining visibility thereof; thus the ease of mounting or releasing of the toner bottles is improved. Since a plurality of guide members 50, 51 that rotatably support the toner bottles are integrally formed with the toner bottle mounting member 35, costs can be reduced compared with the case where these are individually provided. Since the toner bottles 31 to 34 are capable of being mounted or released from above the toner bottle mounting member 35 (image forming device), the working space in the direction of the axis of rotation that had to be provided conventionally becomes unnecessary, making it possible to select the location of installation of the image forming device without having to pay attention to the side from which mounting/release of the toner bottles 31 to 34 should be effected and/or their direction of installation.

Since in this embodiment the toner bottles 31 to 34 are mounted by being laid in the width direction (X direction) of the image forming device as seen from the side of the front face C2 of the image forming device wherein the toner bottle mounting member 35 is mounted, visibility thereof when viewed from the front face side can be further improved. Since the line 03 joining the centers of rotation of the toner bottles 31 to 34 is arranged to be substantially parallel with the line 01 joining the developing devices, the length of the toner movement channels 38 respectively linking the toner bottles 31, 32, 33, 34 and the developing devices 12Y, 12C, 12M, 12K can be made uniform; this enables the components used to constitute the toner movement channels 38 to be standardized, so reducing costs.

Since, in this embodiment, the line 03 joining the centers of rotation of the toner bottles 31 to 34 is substantially parallel with the line 02 joining the centers of rotation of the photosensitive body drums, the layout thereof in the image creation section 8 is aligned, making it possible to reduce the overall size of the device.

Figure 7:
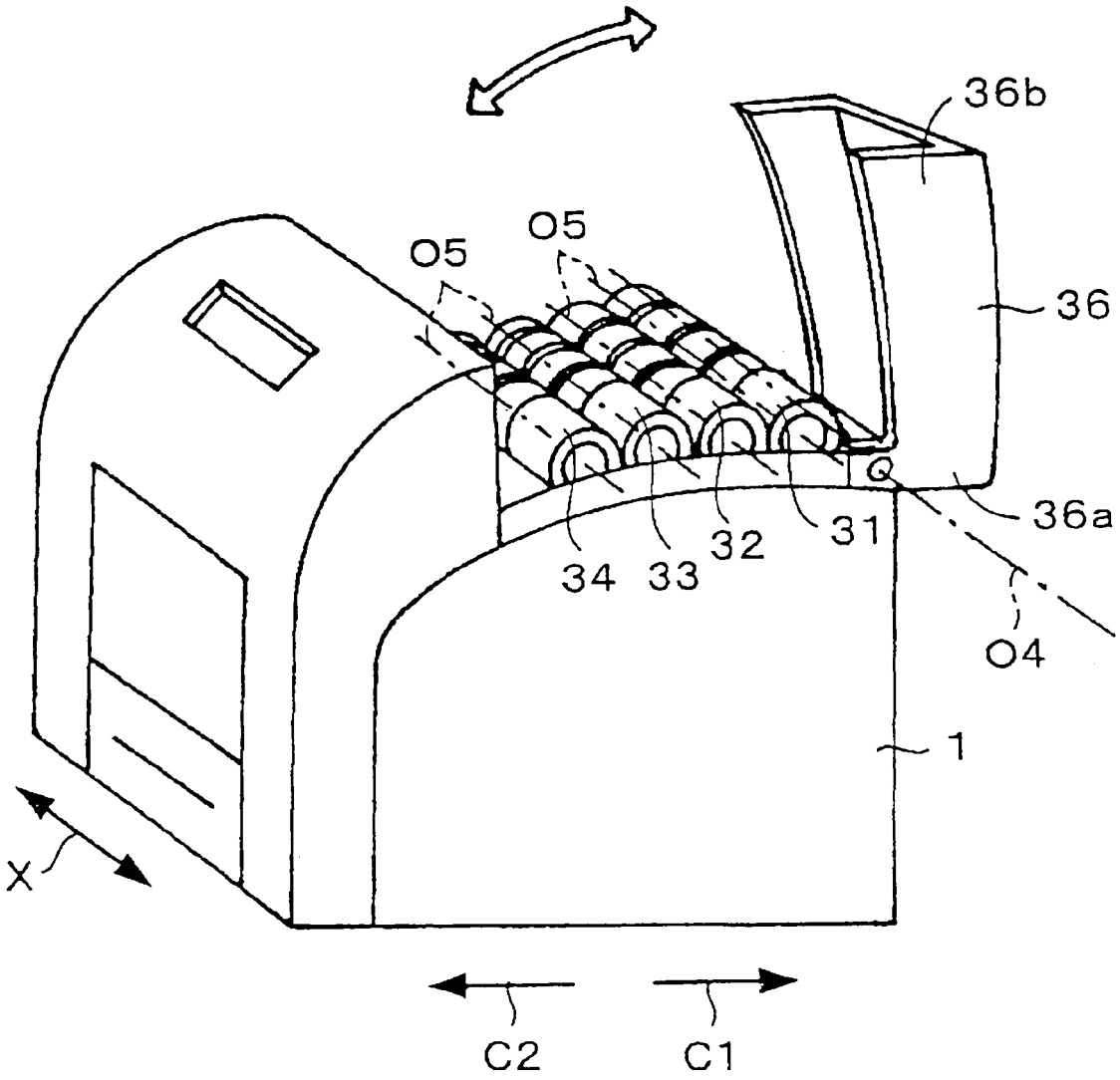
FIG. 7 is a perspective view showing the relationship between the cover member of the image forming device and the toner container.

As shown in FIG. 1 and FIG. 7, on the top of the device main unit 1, there is provided a cover member 36 that covers the mounted toner bottles 31 to 34. This cover member is a resin molding and comprises a stacking unit 25. One end 36*a* of the cover member 36 that is positioned towards the inside of the device is freely rotatably supported by means of a support shaft 37 that extends in the width direction X1 at the end of the toner bottle mounting member 35. The opening/closing end 36*b* of the cover member 36, which is positioned on the front face side of the device, taking the end 36*a* thereof as being in the middle seen from the front face side of the device, is therefore freely openable/closeable towards the inside of the device, from the front face side, with respect to the device main unit 1. In this embodiment, the toner bottles 31 to 34 are mounted on the toner bottle mounting member 35 such that their axis of rotation 05 is substantially parallel with the axis of rotation 04 of the cover member 36.

With such a construction, the cover member 36 that covers the toner bottles 31 to 34 mounted at the top of the device main unit 1 is freely rotatably supported on the toner bottle mounting member 35, so the appearance thereof can be made more attractive by hiding the toner bottles 31 to 34 within the device main unit 1 by covering these with the cover member 36. And mounting/release of the toner bottles can be facilitated by exposing the toner bottles 31 to 34 to the outside at the top of the device main unit 1 by the opening the cover member 36. In addition, since the axis of rotation 05 of the toner bottles 31 to 34 and the axis of rotation 04 of the cover member 36 are substantially parallel, there is no possibility of snagging on the cover member 36 when the toner bottles 31 to 34 are mounted/released, so ease of performing these operations is improved. Since the cover member 36 is open/closed about the rotary shaft 37 on the inside of the device, in the open condition of the cover member 36, all of the toner bottles can be surveyed from the front face of the device i.e. visibility and ease of operation can be improved.

In this embodiment, the cover member 36 was supported so as to be free to be opened or closed by arranging a rotary shaft 37 extending in the width direction of the device within the device. However, it would also be possible to make the cover member 36 free to be open/closed at the side of the device for example by arranging the rotary shaft 37 such that its axial direction is positioned in the forwards/rearwards direction of the device as indicated by the arrows C1, C2 on the wall section 34A or wall section 35B positioned in the width direction X. In this case, the toner bottles 31 to 34 are mounted in a direction substantially orthogonal with respect to the axis of rotation 04 of the cover member 36.

Figure 8:
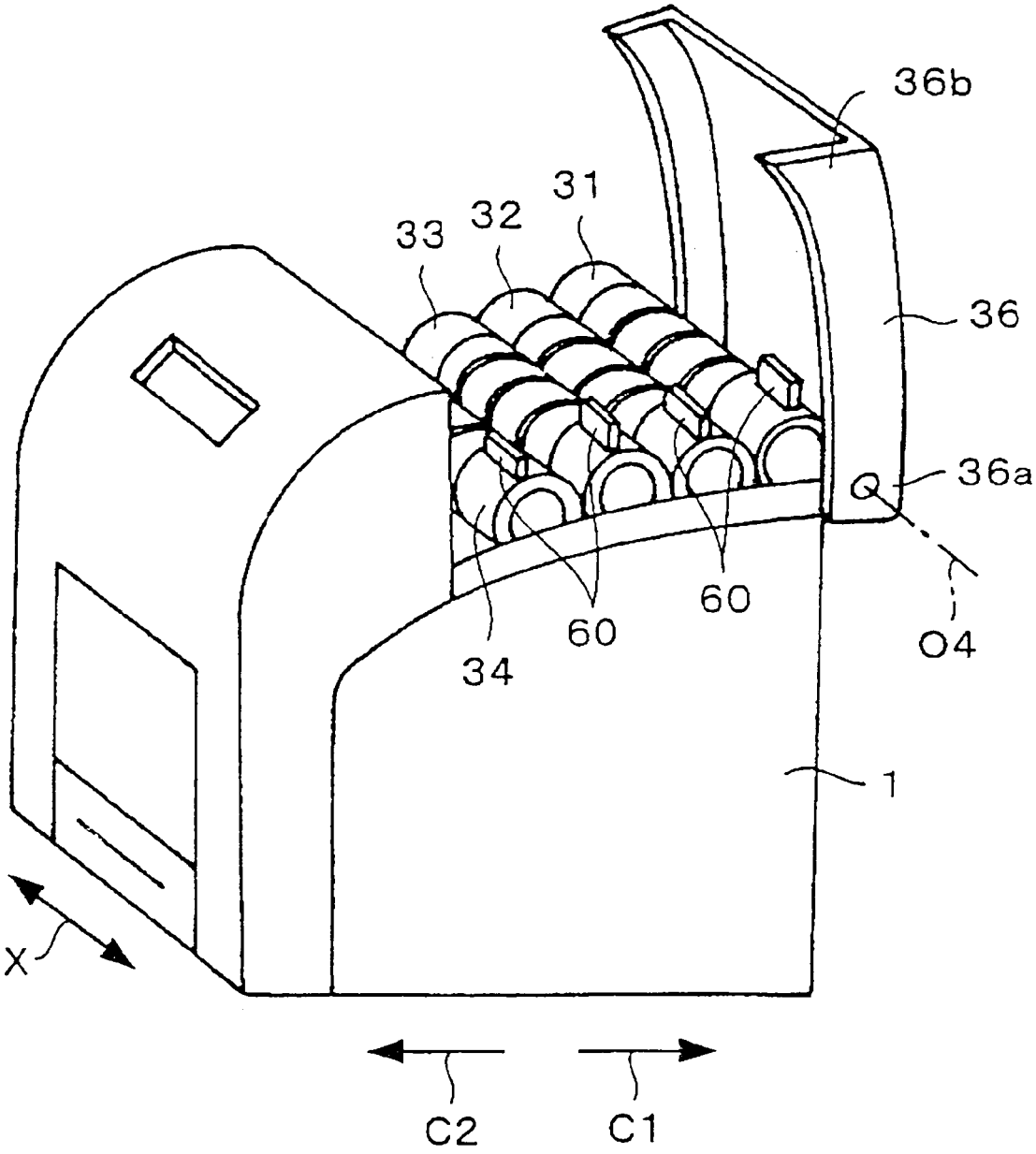
FIG. 8 is a perspective view of the image forming device wherein a toner container comprising a handle at one end thereof is mounted.
Figure 9:
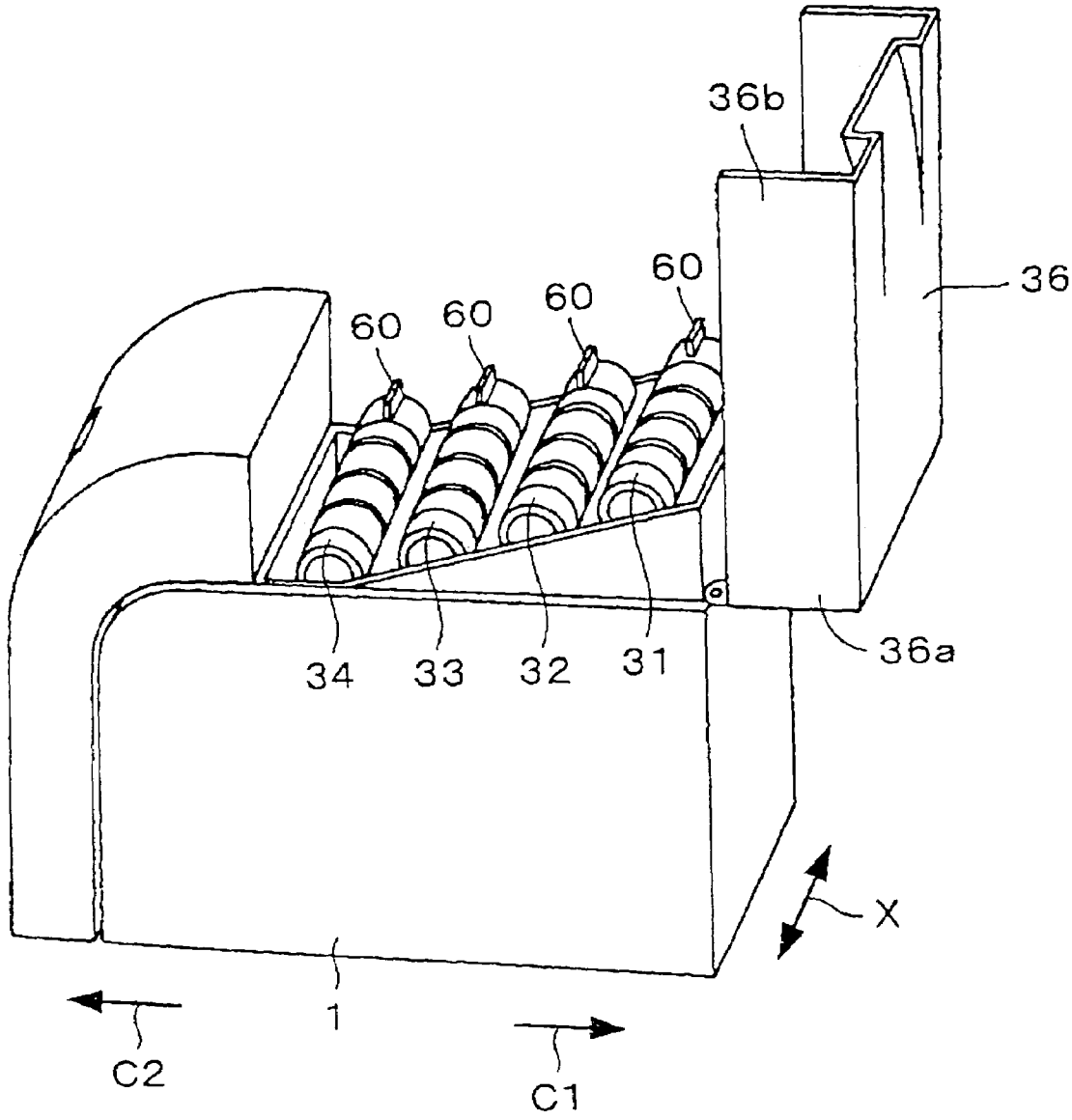
FIG. 9 is a perspective view of the image forming device wherein a toner container comprising a handle at the other end thereof is mounted.
Figure 10:
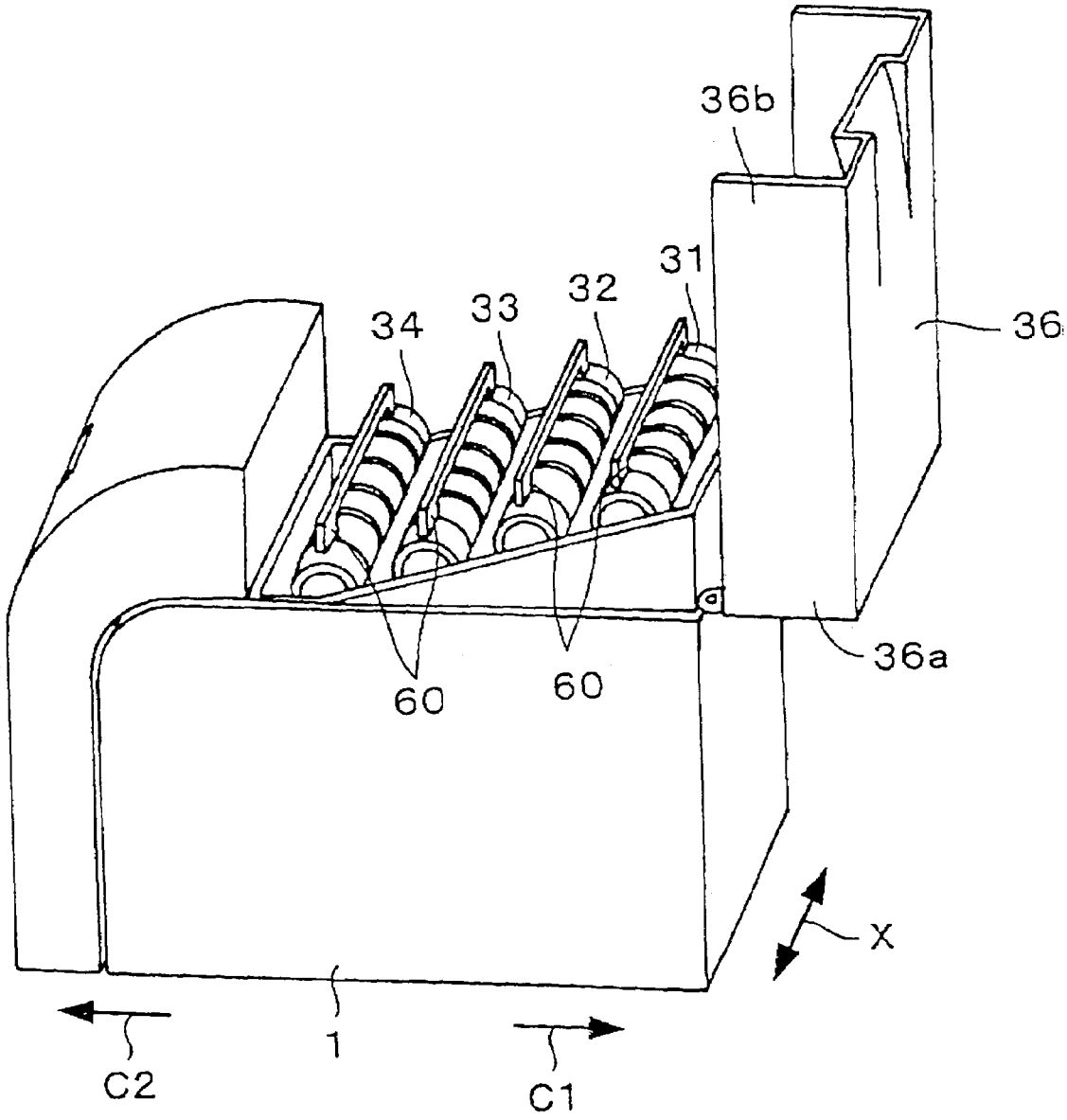
FIG. 10 is a perspective view of the image forming device wherein a toner container comprising a handle in the middle thereof is mounted.
Figure 11:
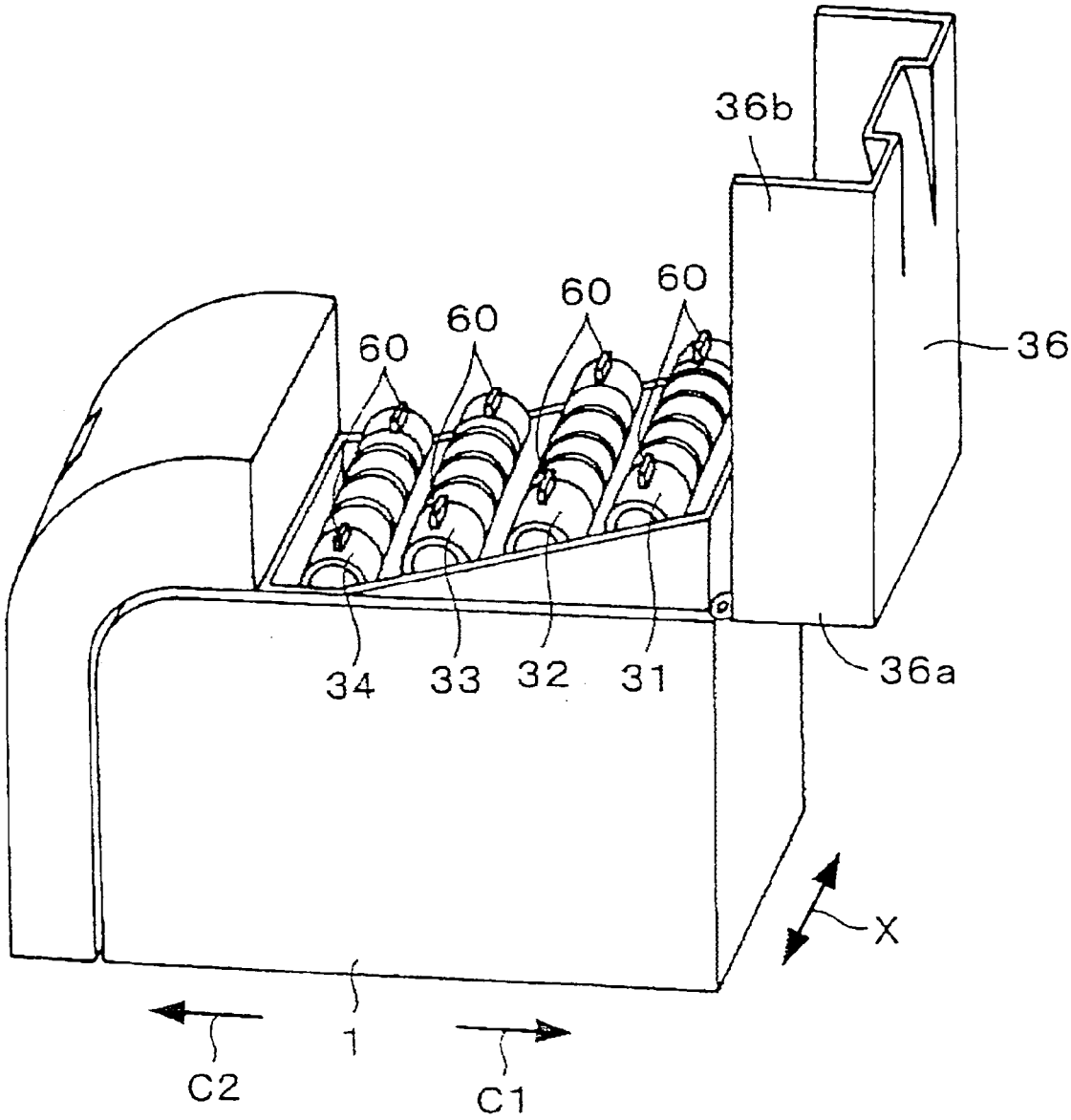
FIG. 11 is a perspective view of an image forming device wherein a toner container comprising handles at both ends thereof is mounted.

FIG. 8 shows the case where a handle 60 is provided in a location positioned on the right-hand side of the device main unit 1 at one end in the width direction X i.e. the direction of the axes of rotation of the toner bottles 31 to 34 and FIG. 9 shows the case where a handle 60 is provided in a location positioned on the left-hand side of the device main unit 1 i.e. at one end in the width direction X of the toner bottles 31 to 34, respectively. FIG. 10 shows the case where a handle 60 is provided in the middle in the width direction X of the toner bottles 31 to 34 and FIG. 11 shows the case where handles 60 are provided at both ends in the width direction X of the toner bottles 31 to 34, respectively. For example in the case where the bottles are mounted on the toner bottle mounting member 35 such that the fixed tubular section 332 of the tubular bottles 31 to 34 is positioned on the right-hand side as seen from the device front face, a handle 60 may be integrally formed, or a separately formed handle 60 may be mounted, towards the end face 335 of the fixed tubular section 332 or the rotary tubular section 331 or in the middle of the rotary tubular section 331.

When such a handle 60 is provided at one end of the toner bottles 31 to 34 positioned on the right-hand side of the device main unit 1, ease of mounting/release can be improved for a right-handed user. When the handle 60 is provided at one end of the toner bottles 31 to 34 positioned on the left-hand side of the device main unit 1, ease of mounting/release can be improved for a left-handed user. If the handle 60 is provided in the middle or at both ends of the toner bottles 31 to 34, ease of mounting/release can be improved for both left-handed and right-handed users.

Figure 12:
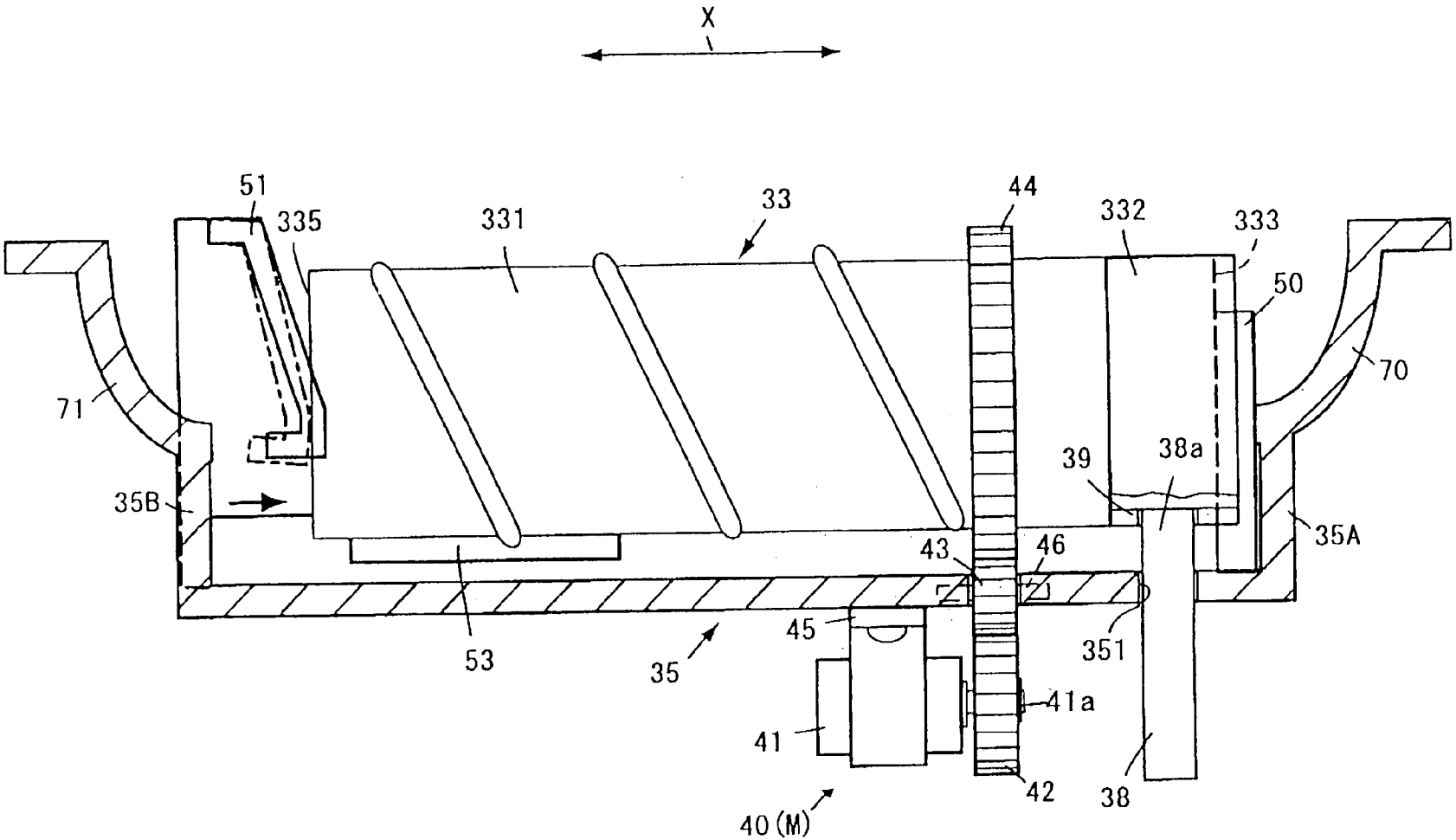
FIG. 12 is a cross-sectional view showing the construction of a toner container mounting member comprising a larger diameter section in the direction of the axis of rotation.

In the example shown in FIG. 12, raised sections 70, 71 formed such as to provide increased intervals between the ends of the toner bottles are formed on the wall sections 35A and 35B facing the guide grooves 333 and end faces 335 at both ends of the bottles arranged in the width direction X i.e. the direction of the axis of rotation of the toner bottles.

If such raised sections 70, 71 are formed on the toner bottle mounting member 35, the separation between the toner bottles and the toner bottle mounting member 35 can be kept wide, thereby facilitating gripping of the toner bottles during mounting/release, and so improving ease of mounting/release. In more detail, since raised sections 70, 71 are respectively provided on the wall section 35A positioned on the right-hand side of the device main unit 1 and on the wall section 35B positioned on the left-hand side of the device main unit 1, it becomes easy for both left-handed users and right-handed users, or a single user with both hands, to grip the toner bottles.

In the example of FIG. 12, the raised sections 70, 71 are respectively formed and arranged by integral molding on the wall sections 35A, 35B, but it would also be possible for a raised section 70 or raised section 71 to be integrally formed solely on either one of the wall sections 35A or 35B. If a raised section 70 is formed on the wall section 35A, this facilitates gripping of the bottles by a right-handed user; if a raised section 71 is formed on the wall section 35B, this facilitates gripping of the toner bottles by a left-handed user: thus ease of operation is improved.

The location of arrangement of the raised sections 70, 71 is not restricted to the wall sections 35A, 35B and they could be formed on the toner bottle mounting member 35 facing the middle of the toner bottles.

Figure 13:
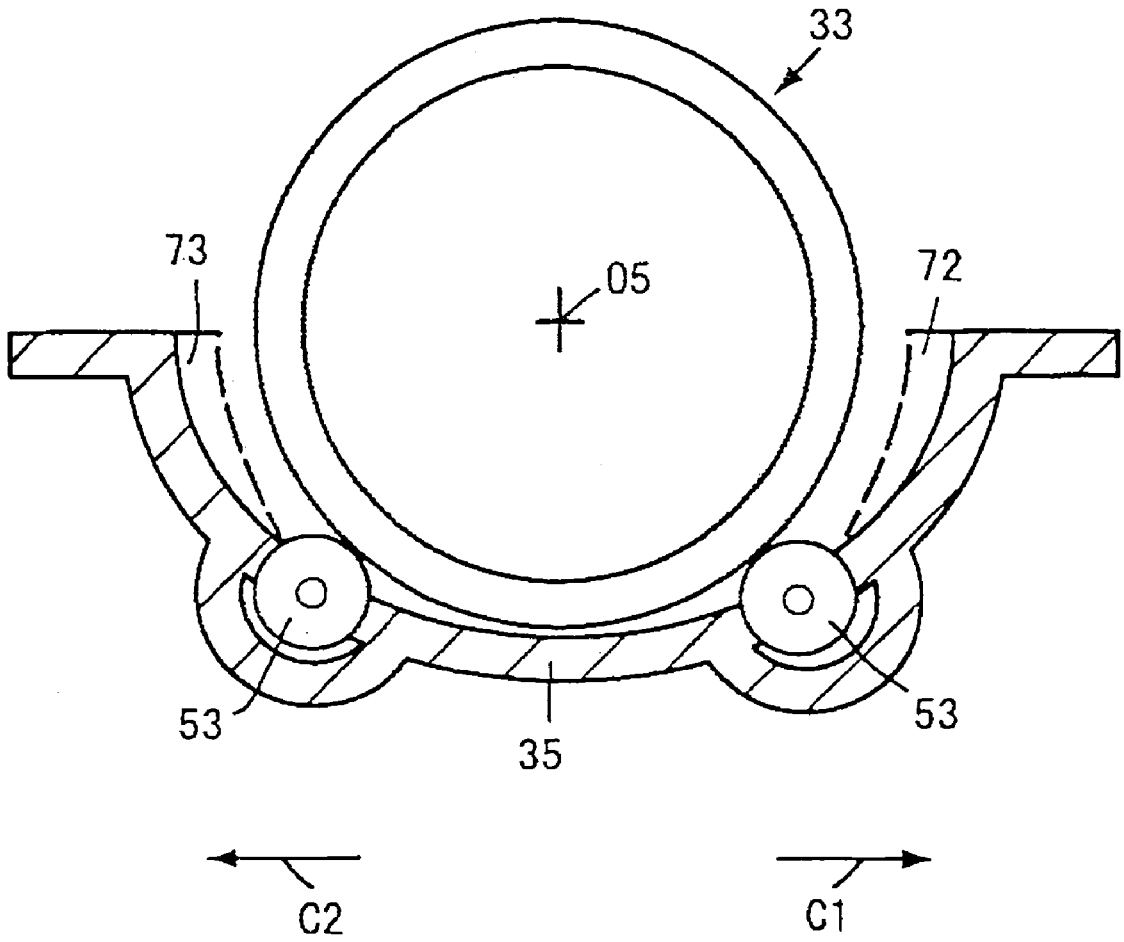
FIG. 13 is a cross-sectional view showing the construction of a toner container mounting member comprising a larger diameter section at both ends in the direction of the axis of rotation.

FIG. 13 shows a case where raised sections 72, 73 formed such that the interval of the toner bottles is increased are formed and arranged by integral molding in the vicinity of the toner bottles, in a direction orthogonal to the width direction X i.e. the direction of the axes of rotation of the toner bottles. In FIG. 13, the raised sections 72, 73 are formed on the upstream side and downstream side of the opposing faces 35C of the toner bottle mounting member 35 facing the toner bottles in the direction of rotation of the toner bottles.

Specifically, the raised section 72 is respectively formed on the opposing faces 35C positioned on both sides of the inside C1 of the device and the front C2 of the device, in the toner bottle mounting member 35, on either side of the toner bottles.

Consequently, when mounting or releasing the toner bottles, the user's hand can be inserted to below the bottle from the raised section 73 at the front of the device or from the raised section 72 on the inner side of the device, so the toner bottle can easily be gripped, thereby improving the ease of performance of this operation. If a raised section 73 is formed and arranged in the vicinity of the toner bottles at the front of the device, the toner bottles can easily be grasped from below; if a raised section 72 is formed and arranged in the vicinity of the toner bottles on the inner side of the device, the toner bottles can easily be gripped from above.

In FIG. 13, raised sections 72, 73 were respectively formed on the upstream side and a downstream side of the direction of rotation of the toner bottles; however, a mode is also possible in which either one or other of a raised section 72 or raised section 73 is formed on the upstream side or downstream side. Regarding the upstream side and downstream side of the direction of rotation of the toner bottles, it should be noted that it is also possible to form and arrange a raised section 72 on the downstream side and a raised section 73 on the upstream side by making the directions of mounting of the toner bottles with respect to the toner bottle mounting member 35 opposite directions to left and right.

The raised sections 72, 73 could also be formed on the opposing face 35C with greater length in the direction of the axis of rotation so as to cover the entire lengths of all of the toner bottles, or an embodiment could be adopted in which they are formed and arranged on the rotary tubular section 331 or on the opposing face 35C facing the fixed tubular section 332, or partially on the opposing face 35C, facing the middle section of the toner bottles.

When the toner bottles are mounted on the toner bottle mounting member 35, their visibility is increased as the mounted toner bottles project further from the opposing face 35C. Regarding the amount of this projection, the opposing face 35C facing the toner bottles may be formed in arcuate shapes so as to conform to the peripheral surfaces of the bottles, such that at least half of the periphery of the toner bottles is exposed.

As shown in FIG. 1, the toner bottle mounting member 35 is inclined downwards from the inner side of the device towards the front face of the device, so a step is produced in the opposing face 35C with respect to the toner bottles i.e. the toner bottles 31 to 34 are formed so as to be mounted in stepwise fashion. Thus when the toner bottles 31 to 34 are mounted and held in stepwise fashion along the front face of the device from the inner side of the device, the amount of overlap of the toner bottles when viewed from the front face of the device becomes small, making it possible to further improve visibility of the toner bottles.

Figure 14:
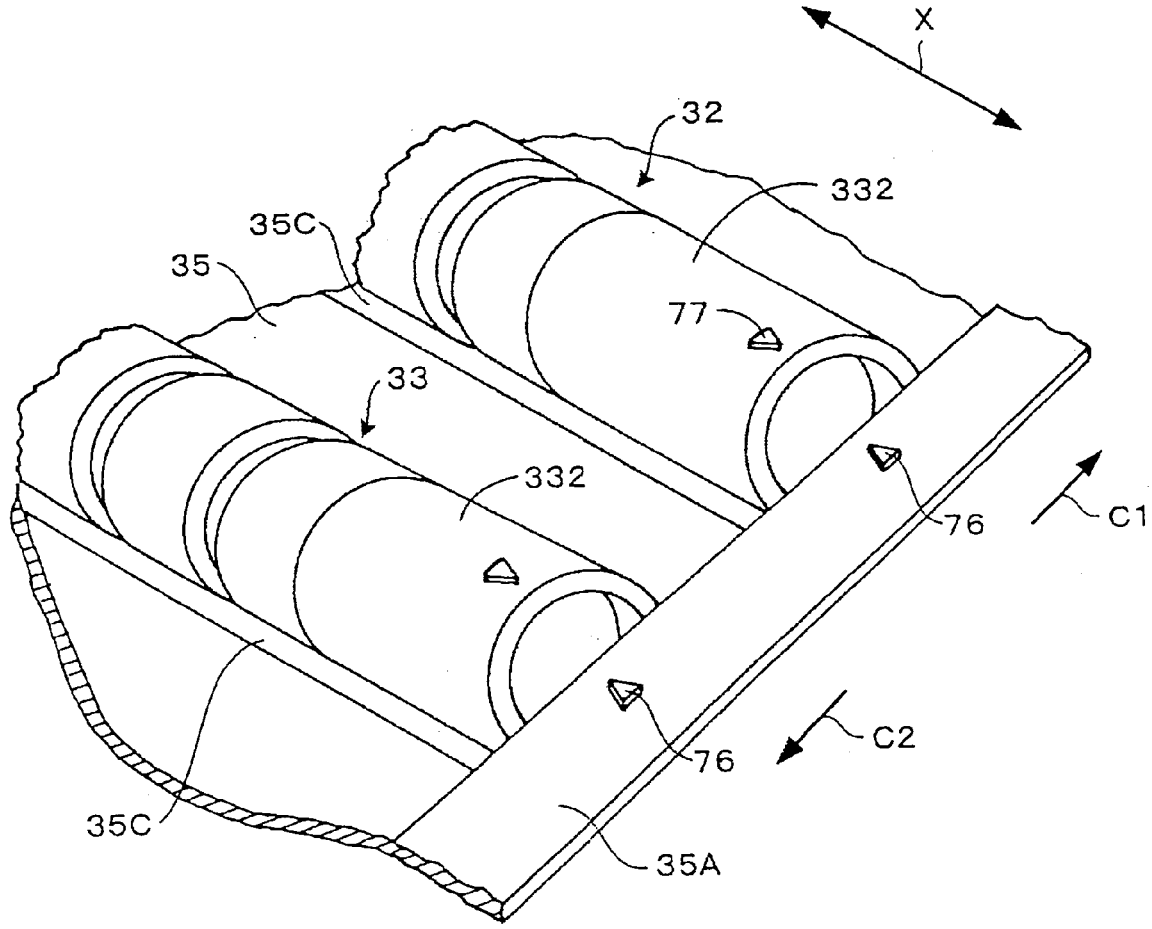
FIG. 14 is a perspective view showing the construction in the vicinity of a guide mark section provided on the toner container mounting member.

In FIG. 14, an index portion 76 indicating the position of mounting of the toner bottles is provided on the toner bottle mounting member 35. In the example of FIG. 14, the index portion 76 is formed by being integrally formed on the wall section 35A and guide marks 77 are formed corresponding to the index portion 76 on the peripheral face of the fixed tubular section 322 of the toner bottles. Consequently, since mounting/release of the toner bottles can be performed using the index portion 77 to provide guide marks, ease of mounting/release can be further improved.

Figure 15:
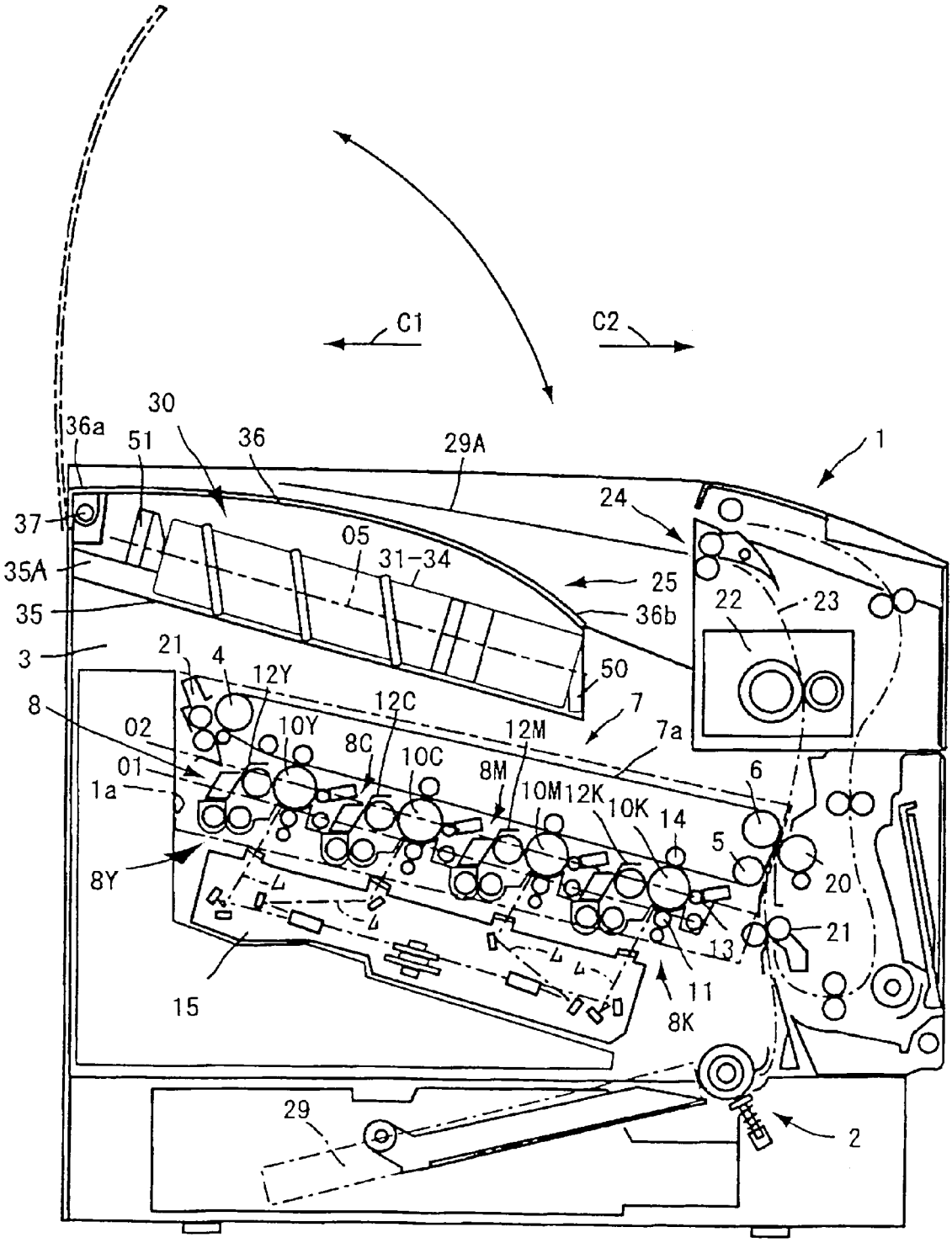
FIG. 15 is an overall constructional view of the image forming device when the toner container is mounted facing axially inwards from in front of the device.
Figure 16:
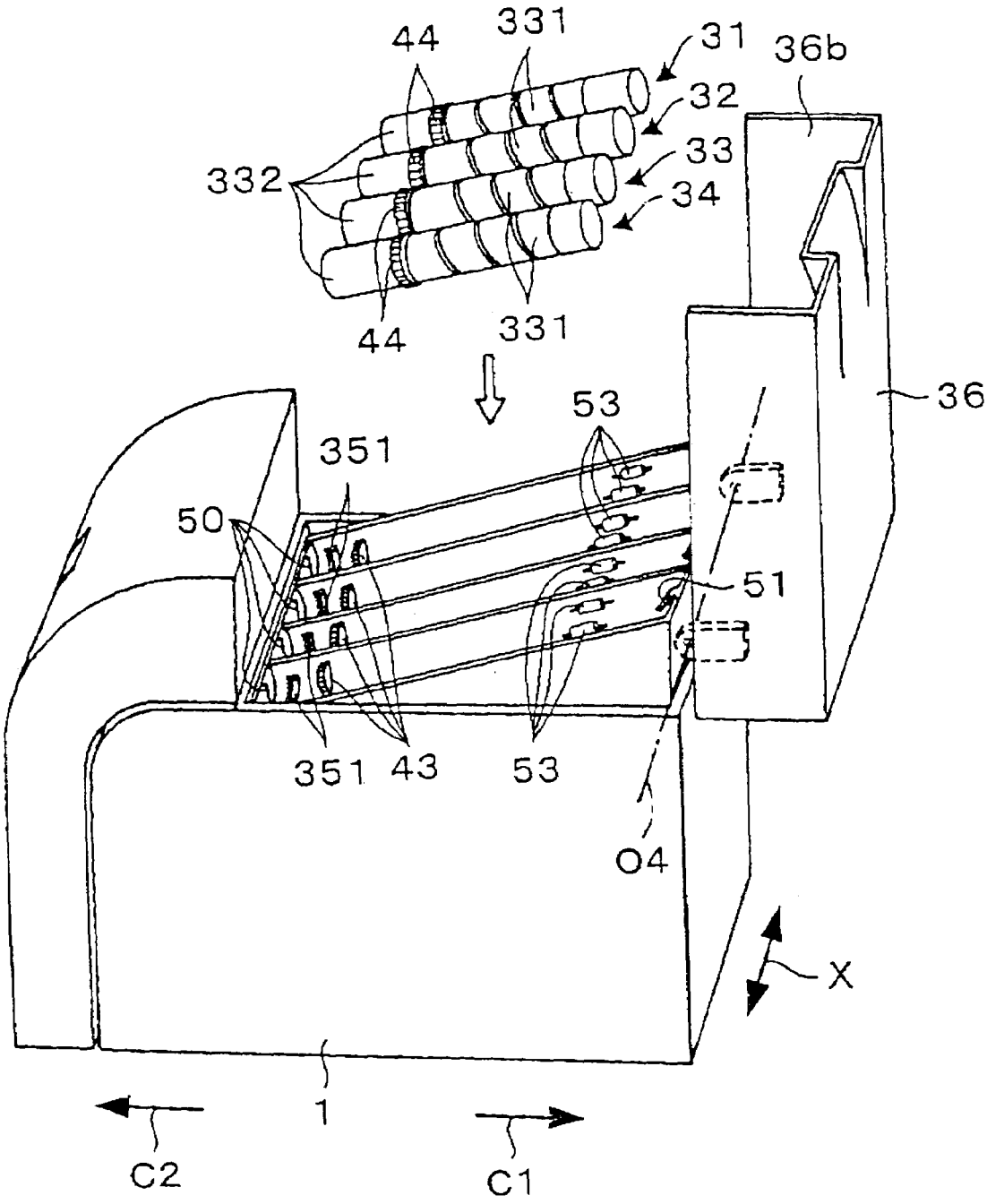
FIG. 16 is a perspective view showing diagrammatically of the construction of the toner container mounting member mounted facing axially inwards from in front of the device.

FIG. 15 and FIG. 16 show an example in which the toner bottles 31 to 34 are mounted by being laid in the axial direction towards the inner side of the device from the front side (front face) of the device, seen from the front face side. In FIG. 15 and FIG. 16, the toner bottle mounting member 35 is inclined downwards towards the side of the device front face C2 from the device inner side C2. In this embodiment, the apertures 351 and guiding members constituted by a plurality of guiding ribs 50 are arranged integrally formed with the end of the toner bottle mounting member 35 that is positioned at the front of the device while guiding members constituted by the plurality of pressing levers 51 are arranged integrally formed with the end of the toner bottle mounting member 35 facing the inner side of the device, respectively. Gearwheels 43 are arranged in the vicinity of the apertures 351 and rollers 53 are arranged in the vicinity of the pressing levers 51, corresponding to the toner bottles.

In this embodiment, the toner bottles 31 to 34 are arranged substantially on the same plane when viewed from the side face of the device and are mounted so as to be capable of being rotated and of being freely released from above by means of the toner bottle mounting member 35 such that the axis 05 of rotation of the toner bottles lies substantially parallel with the line 01 joining the center of arrangement of the plurality of developing devices. Of course, the axis 05 of rotation may be assumed to be substantially parallel with the line 02 joining the plurality of image carriers. That is, the toner bottles 31 to 34 are arranged in the width direction X and are mounted such that the axis 05 of rotation thereof is substantially orthogonal to the axis 04 of rotation of the cover member 36. In this embodiment, the toner bottles are mounted on the toner bottle mounting member 35 such that the toner supply port 39 provided on the fixed tubular section 332 thereof is positioned underneath.

In this way, by mounting the toner bottles 31 to 34 on the toner bottle mounting member 35 lying in the axial direction towards the inside from the front side of the device, visibility of the toner bottles can be increased and, since the toner bottles 31 to 34 are arranged in the width direction X, the area occupied in the width direction X can be reduced.

Since the toner bottles 31 to 34 are arranged such that the axis 05 of rotation thereof is substantially parallel with the line 01 joining the developing devices, the lengths of the toner movement channels 38 respectively linking the toner bottles 31, 32, 33, 34 and the developing devices 12Y, 12C, 12M, 12K can be made uniform, enabling the components used to constitute the toner movement channels 38 to be standardized, and so reducing costs.

Since, in this embodiment, the toner bottles 31 to 34 are arranged such that their axis 05 of rotation is substantially parallel with the line 02 linking the centers of rotation of the photosensitive body drums, the layout thereof in the image creation section 8 is aligned, making it possible to reduce the overall size of the device. Since the face opposite the toner bottles is an inclined face such that the toner supply ports 39 provided on the toner bottles are positioned underneath during mounting, the toner in the bottles can easily move to the toner supply port 39 under its own weight, so the amount of toner accommodated therein that is left behind after use can be reduced.

In FIG. 15 and FIG. 16 also, the cover member 36 that covers the toner bottles 31 to 34 that are mounted on top of the device main unit 1 was freely rotatably supported on the toner mounting member 35, so, by closing the cover member 36, the toner bottles 31 to 34 can be hidden within the device main unit 1, enabling an attractive external appearance to be achieved. The toner bottles 31 to 34 are exposed to the outside at the top of the device main unit 1 by opening the cover member 36, so ease of mounting/releasing the toner bottles can be improved. The cover member 36 can be opened and closed about the rotary shaft 37 within the device, so, in a condition in which the cover member 36 is open, all of the toner bottles can be surveyed from the front face side of the device, making it possible to improve visibility and ease of operation.

In FIG. 15 and FIG. 16 also, a handle 60 as shown in FIG. 8 to FIG. 11 may be provided in a location positioned in front of the device main unit 1 i.e. at one end positioned in the direction of the axis of rotation of the toner bottles 31 to 34, in a location positioned within the device main unit 1 i.e. at one end positioned in the direction of the axis of rotation of the toner bottles 31 to 34, or at both ends or in the middle, positioned in front of or on the inside of the device main unit 1. If such an handle 60 is provided at one end of the toner bottles 31 to 34 positioned in front of the device main unit 1, ease of operation when mounting/releasing can be improved, since the toner bottles can be mounted/released while checking the positions of the toner supply ports 39 and apertures 351. If the handle 60 is provided at one end of the toner bottles 31 to 34 positioned within the device main unit 1, ease of operation is achieved in that mounting/release of the toner bottles can be achieved using as a fulcrum the fixed tubular section 332 on the side of the center of gravity thereof, by allowing the toner to move under its own weight. If a handle 60 is provided in the middle or at both ends of the toner bottles 31 to 34, ease of mounting/release can be improved in respect of both right-handed/left-handed users.

If the raised sections 70, 71 shown in FIG. 12 are respectively formed at the front and within the device of the toner bottle mounting member 35, a large separation between the toner bottles and the toner bottle mounting member 35 can be ensured, making it easy to pick up the toner bottles during mounting/release operation and thereby improving the ease of mounting/release thereof.

In FIG. 15 and FIG. 16, if the raised section 72 or raised section 73 or raised section 72 and raised section 73 shown in FIG. 13 are formed by integral molding on the toner bottle mounting member 35, the user's hand can be inserted from the right-hand side of the device or left-hand side of the device, or from both left and right, below the bottles during mounting/release of the toner bottles, so gripping of the toner bottles is facilitated, improving ease of operation.

In FIG. 15 and FIG. 16 also, an embodiment may be adopted in which an opposing face 35C is formed which is elongate in the direction of the axis of rotation so as to cover the entire length of all of the toner bottles, and in which the raised sections 72, 73 are arranged formed on this opposing face 35C facing the rotary tubular section 331 or the fixed tubular section 332, or in which the raised sections 72, 73 are arranged formed partially on the opposing face 35C facing the middle of the toner bottles.

Even in the case where the toner bottles are mounted vertically on the toner mounting member 35, visibility is improved to the extent that the mounted toner bottles project from the opposing face 35C, so the opposing face 35C facing the toner bottles may suitably be formed in arcuate shape conforming to the peripheral surface of the bottles, such that at least half of the periphery of the toner bottles is exposed.

In FIG. 15 and FIG. 16, the toner bottles are arranged on the same plane and are mounted without providing any difference in height in the width direction X, but the toner bottle mounting member 35 may also be formed such that the toner bottles lie in stepped fashion from right to left of the device or from left to right of the device. If such a formation is adopted, the amount of overlap of the toner bottles when the toner bottles are viewed from the right or from the left of the device is reduced, thereby enabling the visibility of the toner bottles to be improved.

In FIG. 15 and FIG. 16, ease of mounting/release can be improved by providing an index portion 76 indicating the position of mounting of the toner bottles in the vicinity of the guide ribs 50 or pressing levers 51 and performing mounting/release of the toner bottles using the index portion 76 to provide guide marks.

Next, practical examples for effecting electrical connection of this memory unit with the junction of the main unit of the image forming device simultaneously with this mounting when a toner bottle constituting a toner container employed in this embodiment, in particular a toner bottle having a memory unit for reading/writing of characteristic information is mounted on the main unit of the image forming device will be described.

Figure 18:
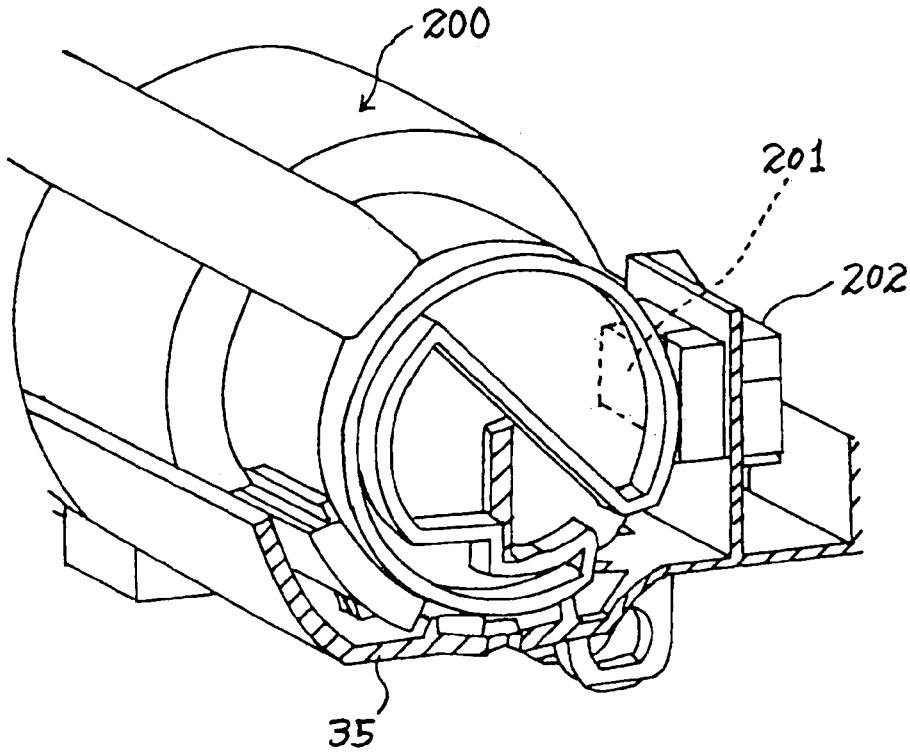
FIG. 18 is a perspective view showing a memory unit mounted on a cap of the toner bottle in a first practical example of this embodiment, and the condition of electrical connection of a data processing unit mounted on a toner bottle accommodating section.

In this embodiment, as a first practical example, as shown in FIG. 18, a memory unit 201 is provided in the cap 200 of the toner bottle and a data processing unit 202 is provided in the toner bottle mounting member 35. In the cap 200 of this toner bottle, there is provided a storage unit 201 capable of outputting/inputting information relating to the toner bottles 31 to 34 and, in the toner bottle mounting member 35 on the side of the main unit of the image forming device 1, there is provided a data processing unit 202 capable of reading/writing data in respect of the memory unit 201. When the toner bottle is set in position/accommodated by the procedure described above in the toner bottle mounting member 35, the memory unit 201 is electrically connected with the data processing unit 202. When this electrical connection is performed, operation of the image forming device in question becomes possible.

With this first practical example, the inconvenience that presented a problem in the prior art, namely, that imperfect fixing of the toner bottle with respect to the main unit of the image forming device made it impossible to operate the image forming device normally, can be eliminated by the mounting of a prescribed memory unit 201 in a cap 200 that is releasably mounted by a rotational operation with respect to the main unit of the image forming device.

As practical examples of the information relating to the toner bottle there may be mentioned the type of machine, the cartridge version, the amount of toner accommodated therein, the toner color, the mode of maintenance, whether the toner bottle is a new bottle or a recycled product, the amount of toner left, the toner end history, or the brand. Also, as examples of the content of data processing that may be performed by the data processing unit 202, there may be mentioned writing/reading, in respect of the storage unit 201, the condition of use of the toner cartridge in the main unit of the image forming device. For example, this may include calculation of the amount of toner consumption based on the number of pixels printed by the main unit of the image forming device, updating from time to time of the toner residual amount information in the memory unit 201, or, when "toner end" is detected by the main unit of the image forming device, updating of this end information in the memory unit 201. In this way, the data processing unit 202 is able to decide whether or not the process cartridge can be used when the main unit of the image forming device reads the information of the memory unit 201. In the absence of such a decision function, there is a possibility of the toner feed function operating imprecisely, or malfunction or failure of the main unit of the image forming device.

Figure 19:
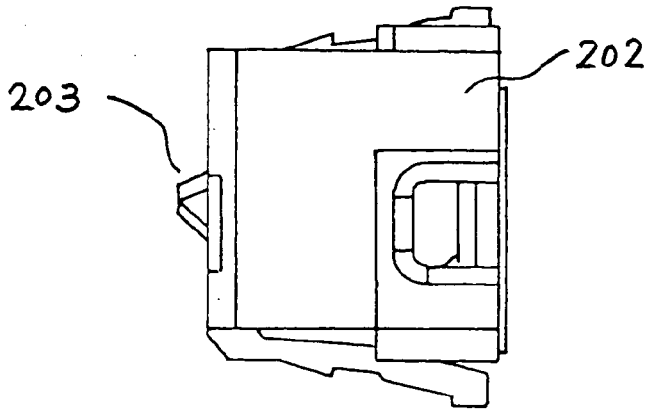
FIG. 19 is a side view of a data processing unit mounted on a toner bottle mounting member in a second practical example of this embodiment.
Figure 20:
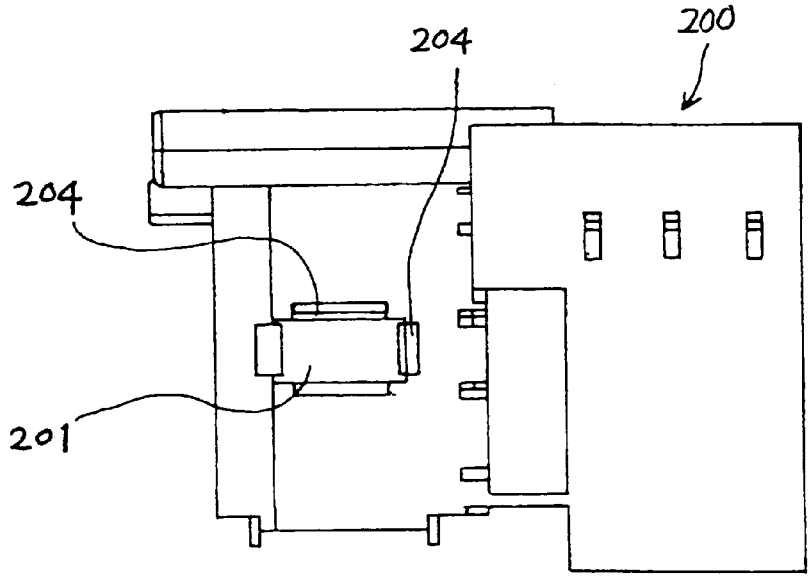
FIG. 20 is a front view showing the mounted condition of the memory unit with respect to the cap of this toner bottle.
Figure 21:
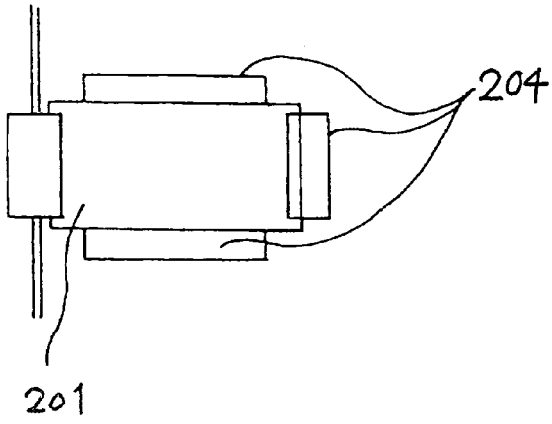
FIG. 21 is a view to a larger scale of a detail of FIG. 20.
Figure 22:
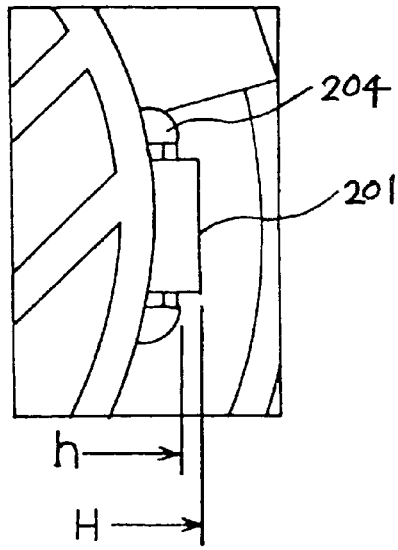
FIG. 22 is a side view of FIG. 21.

FIG. 19 to FIG. 22 shown a second practical example of this embodiment. Specifically, in the image forming device shown in a FIG. 18, if the connector terminal 203 is mounted on the data processing unit 202 as shown in FIG. 19 and a construction is adopted wherein the above electrical contact is obtained by bringing the connector terminal 203 and the memory unit 201 into contact by rotation of the cap 200, depending for example on the shape of the rib whereby the memory unit 201 is fixed in the cap 200, the connector terminal 203 might be deformed during the course of the above contact.

Accordingly, in this second practical example, a radiussed (rounded rib) 204 is employed and the periphery of the memory unit 201 is fixed to the cap 200 by means of this rib 204. Also, a configuration is adopted in which this rib 204 does not project further towards the data processing unit 202 than the memory unit 201, and, in order to achieve this, $h \leqq H$ is specified, where H is the height of the memory unit 201 in the side face view of FIG. 22 and h is the height of the rib 204. If the above-mentioned electrical contact is achieved by setting this cap in position on the toner bottle mounting member 35 of the main unit of the image forming device by rotating the cap 200, even if the connector terminal 203 that is mounted on the data processing unit 202 and the rib 204 come into contact, since radiussing is applied to this rib, deformation or the like of the connector terminal does not occur.

Figure 23:
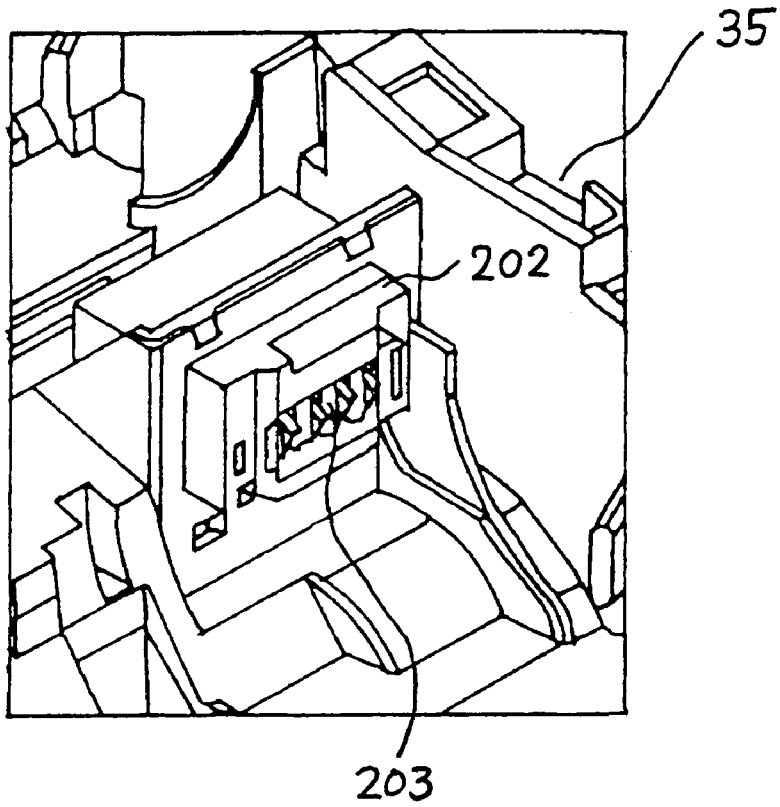
FIG. 23 is a perspective view of a detail of the toner bottle mounting member in a third practical example of this embodiment
Figure 24:
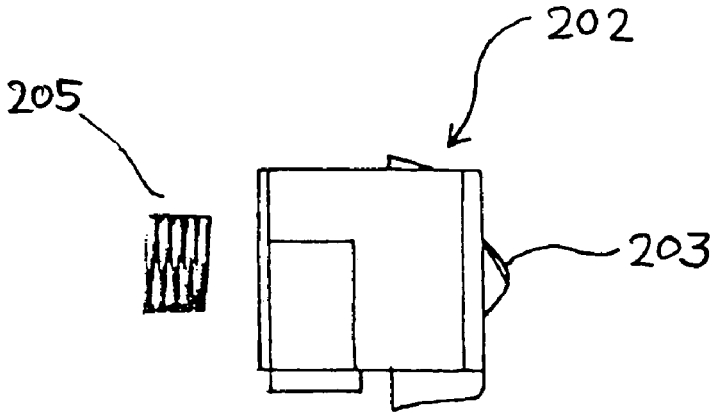
FIG. 24 is a side view of a data processing unit mounted on the toner bottle mounting member.
Figure 25:
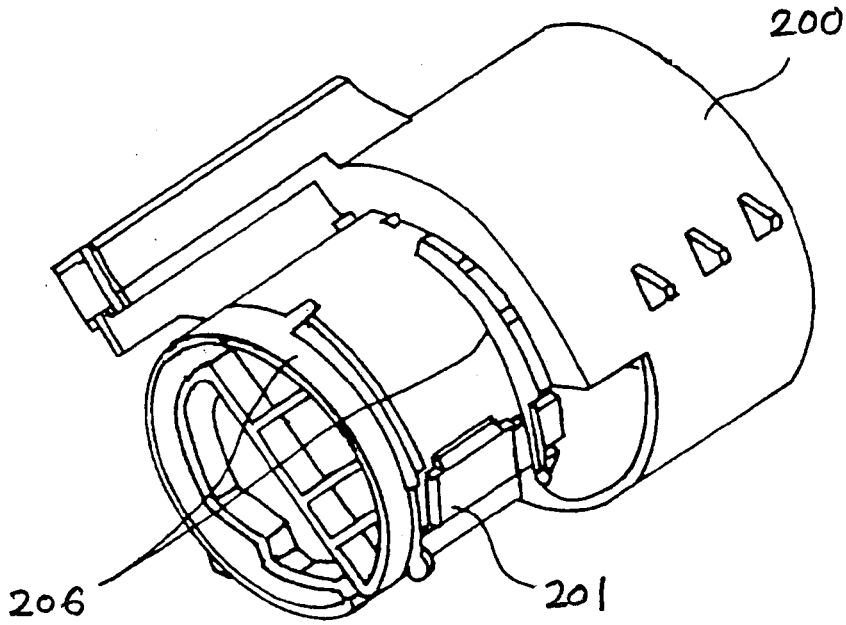
FIG. 25 is a perspective view showing the overall construction of the cap of this toner bottle and the mounted condition of the memory unit with respect to the cap.
Figure 26:
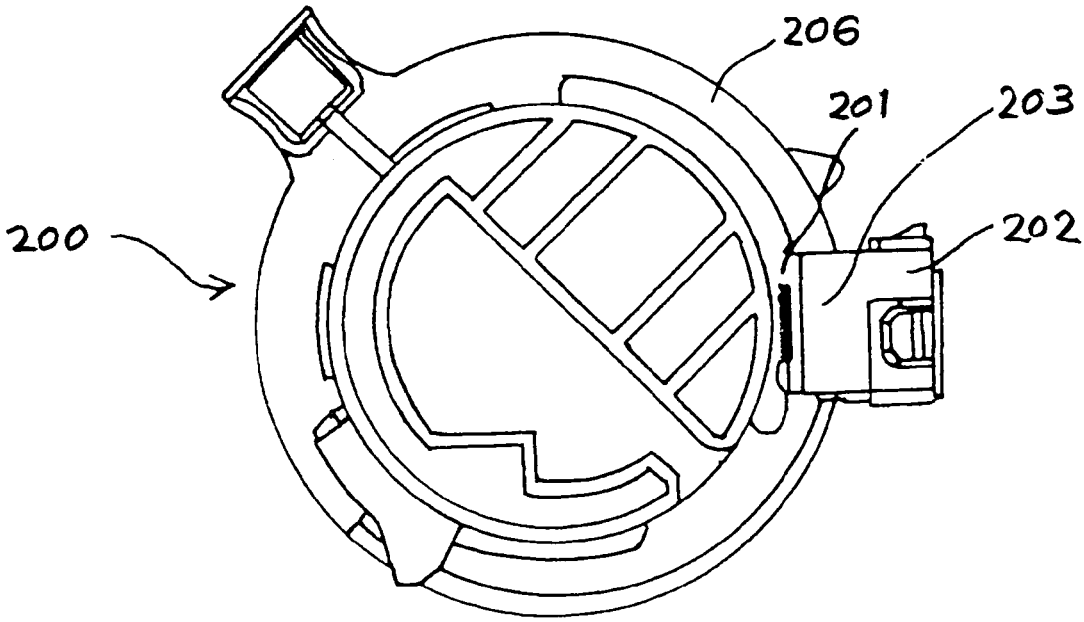
FIG. 26 is a diagram showing the electrically connected condition of the memory unit mounted on this cap and the data processing unit mounted on the toner bottle mounting member, being a view seen from the side of this memory unit and data processing unit.

FIG. 23 to 26 show a third practical example of this embodiment. Specifically, as shown in FIGS. 23 and 24, a resilient body constituted by a first spring 205 is provided on the opposite side to the connector terminal 203 in the data processing unit 202. This spring 205 is a member for applying to the data processing unit 202 bias towards the cap 200. As shown in FIGS. 25 and 26, in the case of this cap 200, a plate-shaped projection 206 is provided that projects at the side of the data processing unit 202, on both sides of the memory unit 201 and along the direction of rotation of this cap. In the case of this plate-shaped projection 206, the height of the projection at the portion where the memory unit 201 is provided is formed lower than that of this memory unit 201 and the height of the projection at portions where the memory unit 201 is not provided is formed greater than that of this memory unit 201.

With such a construction, if the toner bottles are set in position and accommodated in the toner bottle accommodating section of the main unit of the image forming device while rotating the cap 200, since the projecting height of these portions of the plate-shaped projection 206 that do not correspond to the memory unit 201 is formed greater than that of this memory unit 201, there is no possibility of the connector terminal 203 coming into frictional contact with the peripheral surface of the cap 200 when the portions of the plate-shaped projection 206 that do not correspond to the memory unit 201 are rotated with respect to this data processing unit in a condition facing the data processing unit 202.

Also, since the projecting height of the portions of the plate-shaped projection 206 corresponding to the memory unit 201 is formed lower than that of the memory unit 201, when the cap 200 is set in position and accommodated in the toner bottle mounting member 35, the data processing unit 202 advances perpendicularly with respect to the memory unit 201, due to the biasing force of the first spring 205, with the result that the connector terminal 203 comes into contact with the memory unit 201. Consequently, when the cap 200 is rotated and installed on the main unit of the image forming device, there is no possibility of deformation of the connector terminal 203 or rotation of the connector terminal 203 in a condition in frictional contact with the memory unit 201. Thus, in this embodiment, the benefit of protection of the connector terminal 203 is obtained by a guided movement action of the data processing unit 202 achieved by the biasing force of the spring 205 and the plate-shaped projection 206.

Figure 27:
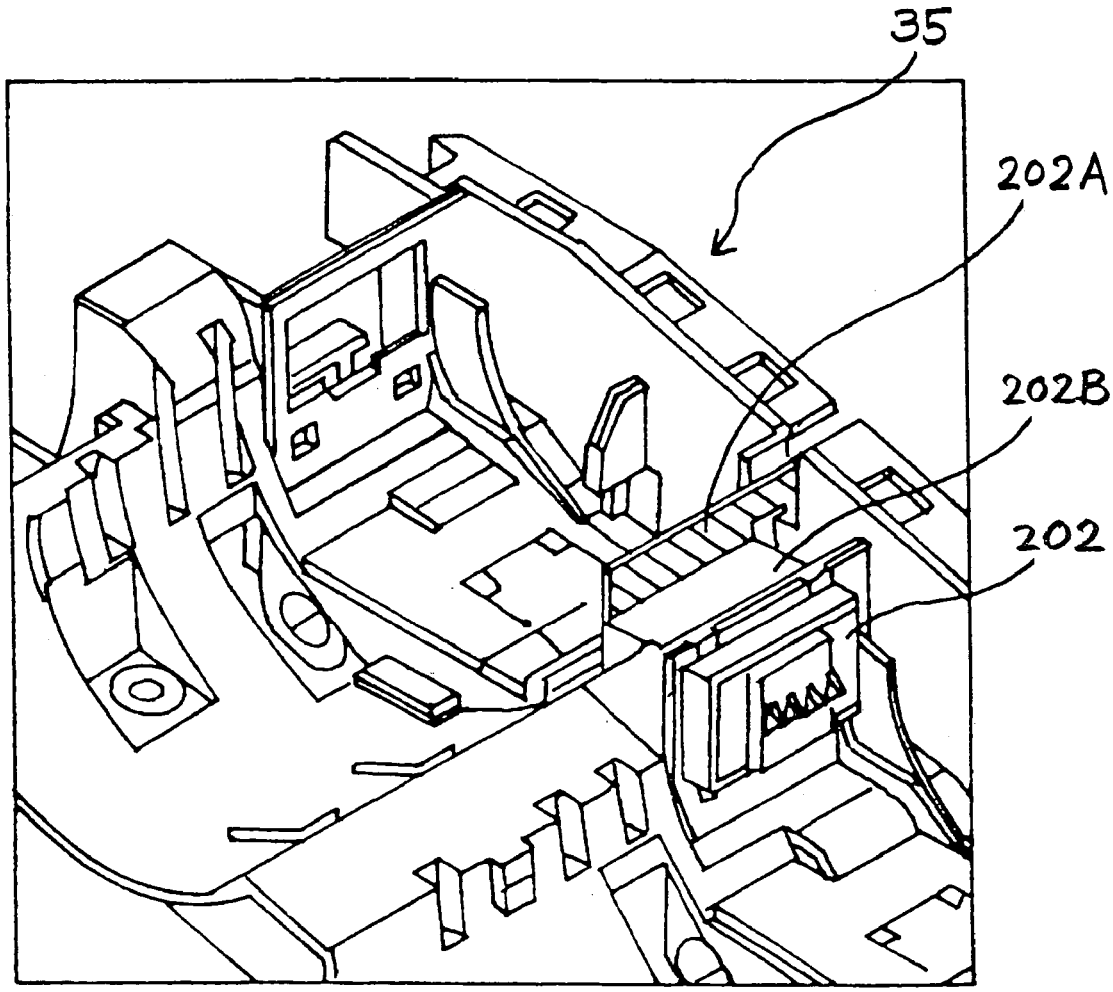
FIG. 27 is a perspective view of a detail of the toner bottle mounting member in a fourth practical example of this embodiment.
Figure 28:
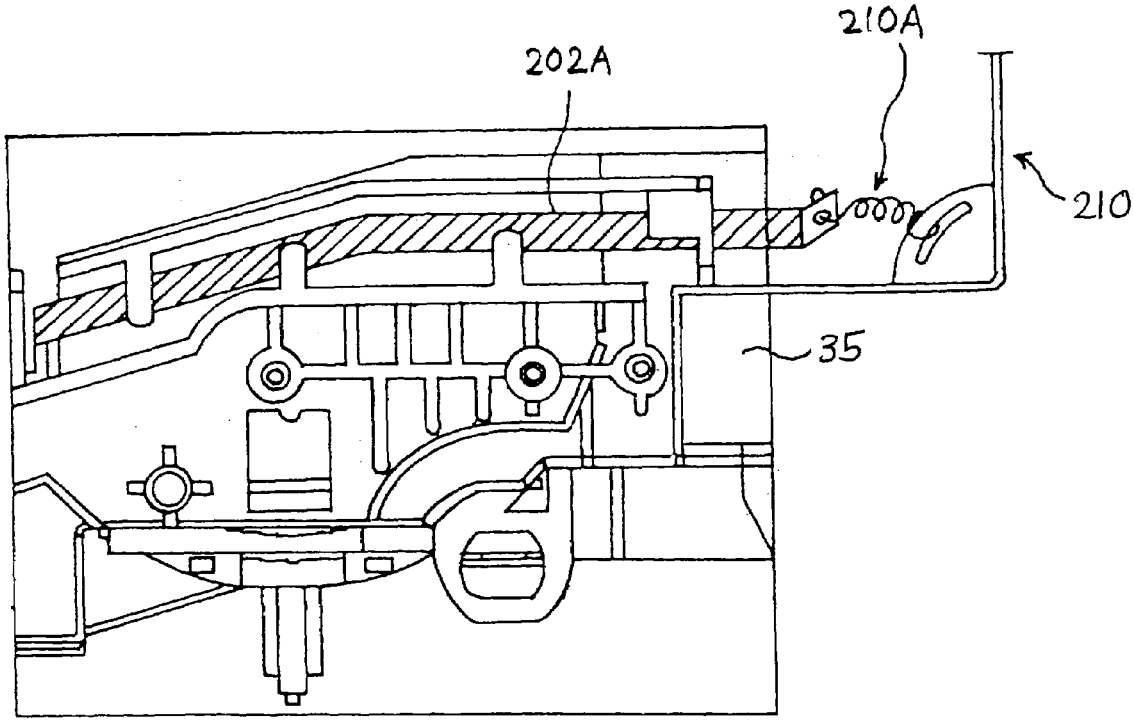
FIG. 28 is a cross-sectional view showing the mounting construction of a paper discharge cover (stacking unit) that opens and closes this toner bottle mounting member.

A fourth practical example of this embodiment is shown in FIGS. 27 and 28. Specifically, in this practical example, just as in the case of the first to third practical examples, on the main unit of the image forming device, a paper discharge cover 210 constituting a stacking unit for recovering printed transfer paper is mounted so as to be capable of releasing or locking the toner bottle mounting member 35. Also, the data processing unit 202 is fitted into a resin member 202A that is provided on the toner bottle mounting member 35, the data processing unit 202 being covered by a protective member 202B. This resin member 202A is linked with the paper discharge cover 210 by means of a second spring 210A.

Then, when the paper discharge cover 210 is closed, simultaneously with the resin member 202A being pressed to the front of the main unit of the image forming device (to the left in FIG. 28), the data processing unit 202 is exposed to the outside from the protective member 202B, and the data processing unit 202 advances in the direction perpendicular to the memory unit 201, coming into contact and so generating electrical contact therewith. Deformation of the connector terminal 203 mounted on the data processing unit 202 can therefore be prevented.

Contrariwise, when the paper discharge cover 210 is opened, the resin member 202A is pulled to the rear of the main unit of the image forming device by means of the second spring 210A and the data processing unit 202 is thereby hidden in the interior of the protective member. The electrical connection of the data processing unit 202 and the memory unit 201 is thereby cut off, so the inconvenience of the image forming device operating whilst the paper discharge cover 210 is still open cannot occur. In other words, operation of the image forming device is only made possible by closure of the paper discharge cover 210.

The following benefits are obtained according to these embodiments.

(1) Since the toner containers that effect supply of toner by being themselves rotated are laid in the same direction on a toner container mounting member on which a plurality of toner containers is mounted, and can be mounted/released from above, the operation of mounting/release of the toner containers can be performed while guaranteeing visibility, thereby improving ease of mounting/release of the toner containers. Furthermore, since a plurality of guide members that rotatably support the toner containers are integrally formed, costs can be lowered compared with the case where these are individually provided.

(2) Since working space in the direction of the axis of rotation, which was previously required when the toner containers were mounted/released becomes unnecessary, the location of installation of the apparatus can be selected without needing to pay attention regarding the disposition of the side where the toner containers are to be mounted/released.

(3) Since the toner containers are mounted laid in the width direction of this apparatus as seen from the front face side of the apparatus where the toner container mounting member is mounted, visibility can be further improved.

(4) Since the toner containers are mounted laid towards the inner side from the front side of this apparatus as seen from the front face side of the apparatus where the toner container mounting member is mounted, visibility can be further improved and the area that is occupied in the width direction of the apparatus can be reduced.

(5) Since the cover member that covers the mounted toner members is freely rotatably supported, the external appearance is made more attractive and the toner containers can be exposed to the outside by opening the cover; thus ease of mounting/releasing the bottles can be further improved.

(6) Since a handle is provided on the toner containers, the toner containers can easily be gripped in the mounting/release operation, improving ease of mounting/release.

(7) By providing raised sections formed so as to widen the interval between the toner containers in locations facing one end or both ends or the middle of the bottles positioned in the direction of the axis of rotation of the toner containers, a wide gap between the toner containers and the toner container mounting member can be guaranteed, thereby facilitating picking up of the toner containers during mounting/release operation and thus improving ease of mounting/release.

(8) By forming a face opposite to the toner containers such that at least half of the periphery of the toner containers is exposed, visibility of the toner containers can be improved.

(9) By forming a toner container mounting member such that the toner containers are arranged in stepwise fashion, the amount of overlap of the toner containers is reduced and visibility of the toner containers can be further improved.

(10) By providing an index portion indicating the position of mounting of each toner container on the toner container mounting member, mounting/release of the toner containers can be performed using this index portion to provide guide marks, so ease of mounting/release is further improved.

(11) By making the face opposite the toner containers an inclined face, such that the toner supply ports provided on the toner containers are positioned underneath when these are mounted, movement of the toner within the bottles towards the toner supply port under its own weight is facilitated, making it possible to reduce the amount of accommodated toner left behind when the toner is used.

(12) A memory unit is provided in the toner mounting member that is capable of outputting/inputting information of the toner containers and a data processing unit is provided on the side of the main unit of the image forming device that is capable of reading/writing data in respect of the memory unit. If the memory unit and the data processing unit are electrically connected, the image forming device starts up normally; if they are not connected, the image forming device does not operate. Consequently, the situation of the image forming device being operated in a condition with the toner containers not correctly set in position on the main unit of the image forming device can be prevented.

(13) If the aforesaid electrical connection is performed of the memory unit on the side of the toner containers and the data processing unit on the side of the main unit of the image forming device by setting this toner container mounting member in position on the main unit of the image forming device, even if the connector terminal that is mounted on the data processing unit comes into contact with the rib, thanks to the radiussing of this rib, deformation or the like of the connector terminal cannot occur.

(14) When the toner containers are set in position on the main unit of the image forming device, due to the biasing force of the resilient member, the data processing unit moves perpendicularly to the memory unit and effects contact therewith. Also, during the operation of setting the toner containers in position, there is no possibility of rotation being produced in a condition of frictional contact of the connector terminal with the memory unit. Deformation or the like of the connector terminal, which presents a problem during setting of the toner containers in position onto the main unit of the image forming device, can thereby be prevented.

(15) Thanks to the provision of prescribed projections in a prescribed arrangement, a connector terminal protective effect just as in (14) above can be obtained due to the biasing force of the resilient member and the guided movement action of the data processing unit produced by these projections.

(16) When the paper discharge cover is opened, the data processing unit is not in contact with the memory unit, so electrical connection is not achieved, but when the paper discharge cover is closed the data processing unit moves in the direction contacting the memory unit, so making contact therewith and enabling electrical connection to be performed. Consequently, it is possible to prevent problems such as deformation of the connector terminal or damage or failure thereof due to external force of one type or another when the paper discharge cover is opened.

Various modifications will become possible for those skilled in the art after receiving the teachings of the present disclosure without departing from the scope thereof.

What is claimed is:

1. A toner container mounting member configured to have mounted thereto a plurality of rotatable toner containers, comprising:

a plurality of guiding pressing members corresponding to the toner containers configured to rotatably hold the toner containers, the toner containers having a cylindrical shape and configured to dispense toner from a front end, the pressing members configured to engage with and apply pressure against a back end of the toner containers which is at an opposite side of the toner containers as the front end, the pressing members configured such that the toner containers are mountable and releasable from above.

2. The toner container mounting member as claimed in claim 1, wherein:

the toner containers are mounted by being laid in the width direction of an apparatus in which the toner container mounting member is mounted, seen from the front face side of the apparatus.

3. The toner container mounting member as claimed in claim 2, wherein:

the toner containers are mounted such that the line joining the centers of rotation of the toner containers is substantially parallel with the line joining the centers of arrangement in the direction ofjuxtaposition of a plurality of developing devices provided in the apparatus where the toner container mounting member is mounted.

4. The toner container mounting member as claimed in claim 2, wherein:

the toner containers are mounted such that the lines corresponding to the centers of rotation of the toner containers are substantially parallel with lines corresponding to the centers of rotation of a plurality of image carriers provided in the apparatus where the toner container mounting member is mounted.

5. The toner container mounting member as claimed in claim 1, wherein:

the toner containers are mounted by being laid from the front side towards the inside of an apparatus where the toner container mounting member is mounted, seen from the front face side of the apparatus.

6. The toner container mounting member as claimed in claim 5, wherein:

the toner containers are mounted so as to be substantially parallel with lines corresponding to centers of rotation of developing rollers of developing devices provided in the apparatus where the toner container mounting member is mounted.

7. The toner container mounting member as claimed in claim 5, wherein:

the toner containers are mounted so as to be substantially parallel to lines corresponding to centers of rotation of a plurality of image carriers provided in the apparatus where the toner container mounting member is mounted.

8. The image forming device as claimed in claim 1, wherein:

the toner container mounting member is configured to receive the toner containers which include a handle at both ends which rotate about an axis of rotation.

9. The toner container mounting member as claimed in claim 1, further comprising:

a raised section configured such that a space between the toner container mounting member and one end of the toner container is widened at a location facing one of the ends of the toner container.

10. The toner container mounting member as claimed in claim 1, further comprising:

raised sections respectively configured such that a space between the toner container mounting member and the ends of the toner container is widened at locations facing the ends of the container.

11. The toner container mounting member as claimed in claim 1, further comprising:

a raised section configured such that a space between the toner container mounting member and a middle of the toner container is widened at a location facing a middle of the toner container.

12. The toner container mounting member as claimed in claim 11, wherein:

the raised section is on the upstream side in a direction of rotation of the toner containers.

13. The toner container mounting member as claimed in claim 11, wherein:

the raised section is on a downstream side in a direction of rotation of the toner containers.

14. The toner container mounting member as claimed in claim 11, wherein:

the raised section is at a middle of the toner containers.

15. The toner container mounting member as claimed in claim 1, further comprising:

a raised section configured such that a space between the toner container mounting member and the toner container is widened in a vicinity of the toner container in a direction orthogonal to an axis of rotation of the toner container.

16. The toner container mounting member as claimed in claim 1, wherein:

the toner container mounting member is configured such that at least half of the periphery of the toner containers is exposed.

17. The toner container mounting member as claimed in claim 1, wherein:

the toner container mounting member is configured so that the toner containers are formed so as to be arranged in stepwise fashion.

18. The toner container mounting member as claimed in claim 1, further comprising:

an index portion which indicates positions to mount the toner containers.

19. The toner container mounting member as claimed in claim 1, further comprising:

a face opposite the toner containers arranged at an inclined face such that toner supply ports of the toner containers face downwardly when the toner containers are mounted to the toner container mounting member.

20. The toner container mounting member as claimed in claim 1, further comprising:

a data processing unit configured to read/write a memory unit of the toner containers that stores data corresponding to the toner containers.

21. The toner container mounting member as claimed in claim 20, wherein:

the periphery of the memory unit is fixed to the toner container mounting unit by a radiussed rib and the rib is formed not to project to the outside beyond the memory unit.

22. The toner container mounting member as claimed in claim 20, further comprising:

a resilient body configured to bias the data processing unit towards the toner container wherein:

the data processing unit includes a connector terminal separated from the memory unit of the toner container is set into the toner container mounting member when a cap of the toner container is not aligned to dispense toner, and the connector terminal is brought into contact with the memory unit by the biasing force of the resilient body when the cap of the toner container is aligned to dispense toner.

23. The toner container mounting member as claimed in claim 20, further comprising:

a projection that projects on both sides of the memory unit and at the side of the data processing unit along a direction of rotation of the toner container, the projection having a lower projecting height than the memory unit at portions corresponding to the memory unit and having a greater projecting height than the memory unit at portions that do not correspond to the memory unit.

24. The toner container mounting member as claimed in claim 20, further comprising:

a paper discharge cover which is a stacking unit for holding printed paper mounted to open and cover the toner container mounting member and the toner containers; and a protective member configured to protect the data processing unit by arranging the data processing unit on the inside of the protective member and linking movement of the protective member with a movement of the paper discharge cover in order for the data processing unit to be exposed by the protective member and to contact the memory unit of the toner container member.

25. A toner container mounting member according to claim 1, wherein: the pressing members have a structure which is integrally formed with the toner container mounting member.

26. A toner container mounting member according to claim 1, wherein:

the pressing members have a first end contacting the toner container mounting member and a second end, opposite the first end, free from the toner container mounting member.

27. A toner container mounting member according to claim 1, wherein:

the pressing members are flexible and free at one end which applies pressure against a corresponding one of the toner containers.

28. A toner container mounting member according to claim 1, wherein:

the pressing members are configured to rotatably support a back end of the toner containers.

29. A toner container mounting member according to claim 1, further comprising:

a plurality of rollers configured to support each of the toner containers.

30. A toner container mounting member according to claim 29, wherein:

the plurality of roller comprise exactly two rollers supporting each of the toner containers.

31. A toner supply unit that supplies toner to a developing device for a corresponding color from a toner container accommodating toner, comprising:

a toner container mounting member that rotatably supports the toner container, the toner container mounting member including a pressing member configured to rotatably hold the toner container, the toner container having a cylindrical shape and configured to dispense toner from a front end, the pressing member configured to engage with and apply pressure against a back end of the toner container which is at an opposite side of the toner containers as the front end, the pressing members configured such that the toner container is mountable and releasable from above;

a drive device that rotates the toner container mounted on the toner container mounting member; and a toner movement channel that guides toner discharged from the toner container to the developing device.

32. A toner supply unit according to claim 31, wherein:

the pressing member has a structure which is integrally formed with the toner container mounting member.

33. A toner supply unit according to claim 31, wherein:

the pressing member has a first end contacting the toner container mounting member and a second end, opposite the first end, free from the toner container mounting member.

34. A toner supply unit according to claim 31, wherein:

the pressing member is flexible and free at one end which applies pressure against the toner container.

35. A toner supply unit according to claim 31, wherein:

the pressing member is configured to rotatably support a back end of the toner container.

36. A toner supply unit according to claim 31, further comprising:

a plurality of rollers configured to support the toner container.

37. A toner supply unit according to claim 36, wherein:

the plurality of roller comprise exactly two rollers supporting the toner containers.

38. An image forming device comprising:

a plurality of image carriers on which are formed latent images corresponding to respective colors;

a plurality of developing devices that develop the latent images formed on the image carriers;

a toner supply device that supplies toner of corresponding colors from the toner containers in which toner of a plurality of colors is accommodated to the developing devices; the toner supply device including:

a toner container mounting member that rotatably supports the toner containers, so as to be capable of rotation and mounting/releasing the toner container mounting member including a plurality of pressing members configured to engage with, apply pressure against, and rotatably hold a back end of the toner containers, the pressing members configured such that the toner containers are mountable and releasable from above;

a driving device that rotates the toner containers mounted on the toner container mounting member; and toner movement channels that guide the toner discharged from the toner containers to the developing devices.

39. The image forming device as claimed in claim 38, further comprising:

a rotatably supported cover member that covers the mounted toner containers.

40. The image forming device as claimed in claim 39, wherein:

the toner containers are mounted substantially parallel with an axis of rotation of the cover member.

41. The image forming device as claimed in claim 39, wherein:

the toner container mounting member is configured to receive the toner containers oriented in a direction substantially orthogonal to the axis line of rotation of the cover member.

42. The image forming device as claimed in claim 38, wherein:

the toner container mounting member is configured to receive the toner containers which include a handle at one end which rotates about an axis of rotation.

43. The image forming device as claimed in claim 38, wherein:

the toner container mounting member is configured to receive the toner containers which include a handle in the middle which rotates about an axis of rotation.

44. An image forming device according to claim 38, wherein:

the pressing members have a structure which is integrally formed with the toner container mounting member.

45. An image forming device according to claim 38, wherein:

the pressing members have a first end contacting the toner container mounting member and a second end, opposite the first end, free from the toner container mounting member.

46. An image forming device according to claim 38, wherein:

the pressing members are flexible and free at one end which applies pressure against a corresponding one of the toner containers.

47. An image forming device according to claim 38, wherein:

the pressing member are configured to rotatably support a back end of a corresponding one of the toner containers.

48. An image forming device according to claim 38, further comprising:

a plurality of rollers configured to support a corresponding one of each of the toner containers.

49. An image forming device according to claim 48, wherein:

the plurality of roller comprise exactly two rollers supporting each of the toner containers.

* * * * *